US012225965B2

(12) United States Patent
Jenkins et al.

(10) Patent No.: US 12,225,965 B2
(45) Date of Patent: Feb. 18, 2025

(54) SHOE SOLE

(71) Applicant: Toray Industries, Inc., Tokyo (JP)

(72) Inventors: Stuart Jenkins, Goleta, CA (US); Miki Kasabo, Tokyo (JP); Kazuki Nagayama, Nagoya (JP); Takashi Horinouchi, Nagoya (JP)

(73) Assignee: Toray Industries, Inc., Tokyo (JP)

( * ) Notice: Subject to any disclaimer, the term of this patent is extended or adjusted under 35 U.S.C. 154(b) by 159 days.

(21) Appl. No.: 17/478,464

(22) Filed: Sep. 17, 2021

(65) Prior Publication Data

US 2022/0346492 A1 Nov. 3, 2022

Related U.S. Application Data

(60) Provisional application No. 63/181,273, filed on Apr. 29, 2021.

(51) Int. Cl.
*A43B 13/14* (2006.01)
*A43B 13/04* (2006.01)

(52) U.S. Cl.
CPC ..... *A43B 13/141* (2013.01); *A43B 13/04* (2013.01)

(58) Field of Classification Search
CPC ..... A43B 13/141; A43B 13/04; A43B 13/026; A43B 13/42; A43B 7/14; A43B 7/142; A43B 7/1445; A43B 7/143; A43B 7/1415
See application file for complete search history.

(56) References Cited

U.S. PATENT DOCUMENTS

| | | | | | |
|---|---|---|---|---|---|
| 918,101 | A * | 4/1909 | Toporczer | A43B 7/142 36/168 |
| 1,211,255 | A * | 1/1917 | Spiegel | A43B 7/142 36/179 |
| 1,401,066 | A * | 12/1921 | Galloway | A43B 7/223 36/168 |
| 2,433,034 | A * | 12/1947 | Edinger | A43B 7/142 36/179 |
| 5,025,573 | A | 6/1991 | Giese et al. | |

(Continued)

FOREIGN PATENT DOCUMENTS

| | | | |
|---|---|---|---|
| JP | 2544047 | Y2 * | 8/1997 |
| JP | 3403952 | B2 | 5/2003 |
| JP | 4399491 | B2 | 1/2010 |

OTHER PUBLICATIONS

International Search Report and Written Opinion dated Jul. 19, 2022, of corresponding Application No. PCT/US2022/25871.

(Continued)

*Primary Examiner* — Jameson D Collier
(74) *Attorney, Agent, or Firm* — DLA Piper LLP (US)

(57) ABSTRACT

A shoe sole that is less likely to feel push-up on the sole at the time of landing and suppresses pronation to enable quick weight movement in running or jogging, while being widely available in sports requiring weight movement such as golf, tennis, basketball, soccer, and skateboarding, as well as that is lightweight, has good wearing comfort and provides stable walking even in using on the street or walking. The shoe sole includes a shoe sole main body made of a flexible material, and a plate made of a material having a flexural modulus higher than a flexural modulus of the flexible material constituting the shoe sole main body, in which at least two of the plates are included in the shoe sole main body.

8 Claims, 19 Drawing Sheets

(56) References Cited

U.S. PATENT DOCUMENTS

| | | | | |
|---|---|---|---|---|
| 5,052,130 | A | 10/1991 | Barry et al. | |
| 5,572,805 | A * | 11/1996 | Giese | A43B 13/188 36/31 |
| 6,467,197 | B1 | 10/2002 | Mitsui et al. | |
| 6,973,746 | B2 * | 12/2005 | Auger | A43B 1/0072 36/67 A |
| 2005/0241187 | A1 | 11/2005 | Johnson | |
| 2007/0062065 | A1 * | 3/2007 | Wang | A43B 13/12 36/25 R |
| 2009/0133290 | A1 | 5/2009 | Kawai | |
| 2010/0218397 | A1 | 9/2010 | Nishiwaki et al. | |
| 2011/0088287 | A1 * | 4/2011 | Auger | A43B 13/125 36/114 |
| 2012/0272545 | A1 * | 11/2012 | Chenut | A61F 5/14 36/43 |
| 2015/0121722 | A1 * | 5/2015 | Hirose | A43B 17/02 36/44 |
| 2015/0366290 | A1 | 12/2015 | Chang | |
| 2016/0316852 | A1 | 11/2016 | Zhao et al. | |
| 2016/0353838 | A1 | 12/2016 | Takeshita et al. | |
| 2019/0150563 | A1 | 5/2019 | Shorten | |
| 2019/0357627 | A1 * | 11/2019 | Shanker | B32B 5/26 |
| 2020/0315297 | A1 * | 10/2020 | Recchi | A43B 23/022 |
| 2021/0059355 | A1 | 3/2021 | Vizy | |
| 2022/0142296 | A1 * | 5/2022 | Head | A43B 13/16 |

OTHER PUBLICATIONS

"Shanks: Everything You Need To Know," workingperson.me, Nov. 12, 2020, p. 1, paragraph 3, p. 2, paragraph 1, entire document retrieved from https://workingperson.me/shanks-everything-you-need-to-know/.

International Preliminary Report on Patentability and Written Opinion from counterpart PCT International Application No. PCT/US2022/025871 dated Nov. 9, 2023.

* cited by examiner

SHOE SOLE

TECHNICAL FIELD

This disclosure relates to a shoe sole.

BACKGROUND

In recent years, due to the worldwide pandemic of coronavirus infection, light exercise that can be performed to maintain health has attracted attention amid lockdowns and protracted self-restraint life mainly in urban areas. Among them, the number of people who start running that can be performed by one person at any place is increasing, and many of them are runners who enjoy running for the purpose of maintaining and promoting their health, so-called fan runners. Important sporting goods that are indispensable for them to enjoy running are shoes, and they select and wear from commercially available shoes. Manufacturers design shoes including those for advanced-level persons such as serious runners and athletes, with diversely contriving a shoe sole shape, a cushioning property of a midsole, and a plate.

In particular in recent years, thick-sole rocker shoes have been dominating the trend of the shoe industry. A shoe sole in which a thick shoe sole shape is adopted to mitigate impact from the ground and a rocker shape, which evokes a cradle or a rocking chair, is additionally adopted to facilitate traveling forward has been presented. However, since the shoe sole is soft, there has been no effect of suppressing over pronation (natural movement of a human body that rotates a sole of foot in an inward direction to disperse impact at the time of grounding), which is deemed to be one of causes of running disorder. Furthermore, since the contact area with the ground is small, the foot has been unstable in daily-life use such as on the street, other than in exercise.

A technique has been disclosed in which an elastic material such as a carbon plate is put in such a soft sole to cause the sole to function as a forward propulsion as a spring in a foot length direction (longitudinal direction).

For example, as described in U.S. Pat. No. 5,052,130, a shoe in which a flexible elastic member (carbon fiber reinforced plastic or the like) extending from a forefoot portion to a heel portion is mounted on a midsole has been disclosed. The elastic member is disposed to bend together with the sole of the shoe at every step during walking or running in the region of the bulging portion at the roots of the toes (MTP joints) in the forefoot portion of the wearer, and stores and releases energy in response to the bending. So-called full carbon shoes using carbon fiber reinforced plastic for the elastic member have very high resilience. Full carbon shoes are the standard shoes positioned as top shoes in leading companies for advanced-level persons who mastered a forefoot running style (which refers to a running method in which the forefoot portion lands first) that enables runners to keep running with a stable form by moving their weight well to the forefoot portion of the foot. However, many beginner runners do not have a stable form from the beginning, and since the full carbon shoes are hard, the function of the shoes cannot be sufficiently drawn out for fan runners who run at a relatively slow pace or walk in between. In addition, the wearing comfort is poor, and thus the full carbon shoes have been unsuitable for those runners.

A shoe in which a plate is partially inserted in a local position such as a midfoot portion and a heel portion is also known. US 2019/0,150,563 A discloses carbon fiber reinforced plastic disposed as a spring in the middle of a midfoot portion. That shoe includes a gap for sliding and carbon fiber reinforced plastic (CFRP) is disposed therein to efficiently store and release energy in an elongated plate having a small area compared to a full plate. The influence on running is relatively small compared to a shoe with a full plate. In particular, it cannot be expected to suppress over pronation of the foot when landing the heel first.

JP 4399431 B2 proposes a lightweight shoe in which a corrugated plate is disposed in a heel portion to achieve both cushioning property and stability at the time of heel landing, thereby suppressing over pronation and enabling smooth load (weight) movement from the time of heel landing to the forefoot portion. JP 3403952 B2 discloses a shoe in which an inner instep side shank portion and an outer instep side shank portion of an arch portion are extended from a front-end portion of a plate to a forefoot portion to support the arch of the foot, thereby preventing the arch of the foot from (excessively) twisting against the arch portion and from falling by the arch portion. Furthermore, US 2016/316,852 A discloses a technique that suppresses pronation by providing a pair of carbon fiber reinforced plastic pieces from the heel portion to the midfoot portion. As described above, the placement of the plate on the heel portion can stabilize the heel at the time of landing, and there is an aspect that adopting the plate on the heel portion is easy for a beginner who does not have sufficiently grown calf muscles and Achilles tendons or for a beginner who is recommended a heel-strike (running style in which the heel lands first) running style to prevent running disorders. However, some people feel a sense of push-up on the sole at the time of landing due to the hard plate, and there has been room for improvement in terms of wearing comfort.

It could therefore be helpful to provide a shoe sole that is less likely to feel push-up on the sole at the time of landing and suppresses pronation to enable quick weight movement in running or jogging, while being widely available in sports requiring weight movement such as golf, tennis, basketball, soccer, and skateboarding, as well as that is lightweight, has good wearing comfort and provides stable walking even in using on the street or walking.

SUMMARY

We thus provide:

A shoe sole at least including a shoe sole main body made of a flexible material, and a plate made of a material having a flexural modulus higher than a flexural modulus of the flexible material constituting the shoe sole main body, in which at least two of the plates are included in the shoe sole main body, and two plates of the at least two of the plates satisfy all of Condition 1 to Condition 3 below:

Condition 1: In a transparent bottom view of the shoe sole, one of the two plates of the at least two of the plates is disposed on an inner instep side and the other plate is disposed on an outer instep side with respect to a last center line (hereinafter, referred to as "PCL");

Condition 2: Long axes of the two plates of the at least two of the plates both form an angle in a range of 0° to 30° with respect to the PCL; and Condition 3: When a tip of the shoe sole on a toe side is 1 and a tip of the shoe sole on a heel side is 0, both of the two plates of the at least two of the plates are present entirely in a region of a range of 0.2 to 0.7.

The shoe sole is less likely to feel push-up on the sole at the time of landing and suppresses pronation to enable quick weight movement in running or jogging, as well as that is lightweight, has good wearing comfort, and provides stable walking even in using on the street or walking.

REFERENCE SIGNS LIST

Figure 1:
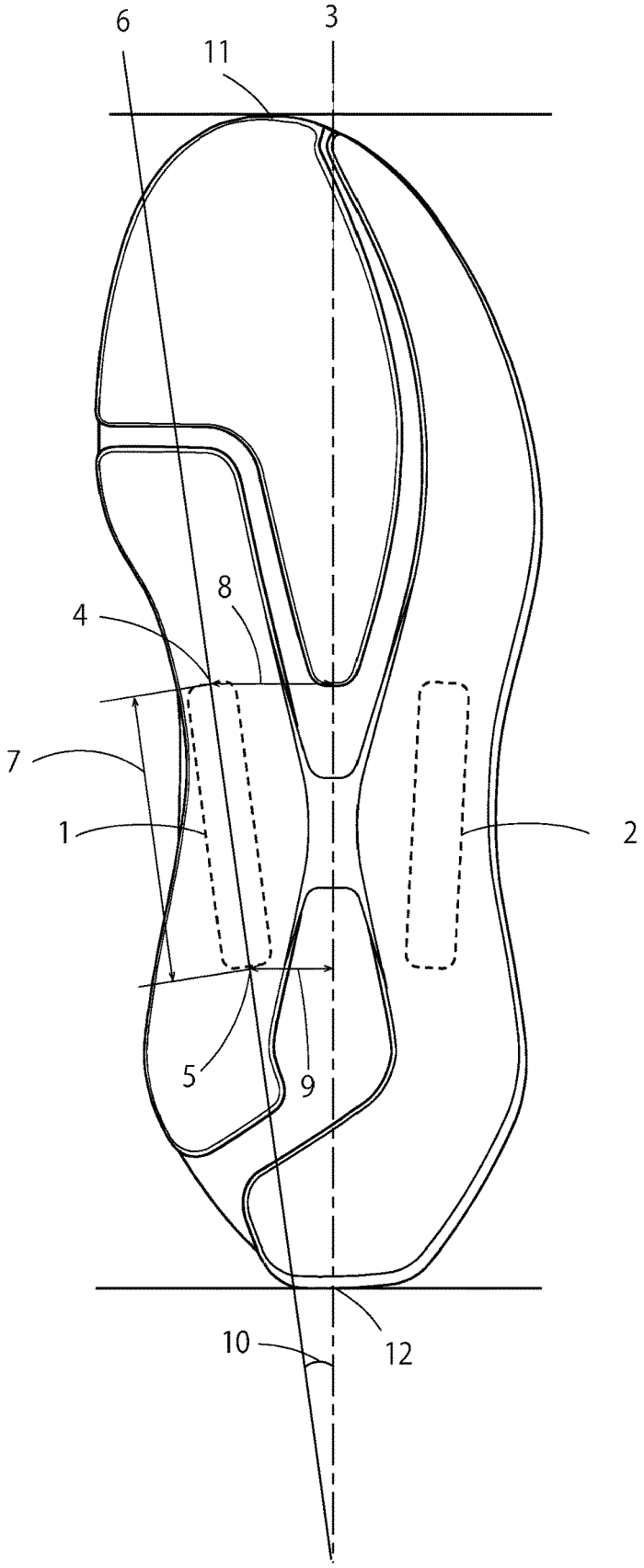
FIG. 1 is a diagram illustrating a relationship between a PCL and an angle of a long axis of a plate in a transparent bottom view of a shoe sole.

1. Plate (first plate)
2. Plate (second plate)
3. PCL
4. P1
5. P2
6. Plate center line
7. L1
8. LP1
9. LP2
10. θ
11. Tip of toe
12. Tip of heel
13. Circumscribed rectangle of first plate
14. Circumscribed rectangle of second plate
15. Outsole
16. Midsole
17. Plate (third plate)
18. Plate (fourth plate)
19. Insole
20. Upper
21. Ground contact surface of shoe sole
22. Upper sole of shoe sole corresponding to placement position of plate 2

DETAILED DESCRIPTION

Our shoe sole main body is made of a flexible material. As the flexible material, for example, a soft elastic member that is bendable and restorable by a force applied during walking at −50° C. and 50° C. and has a good cushioning property is preferably used. Specifically, a foam of a thermoplastic synthetic resin such as ethylene-vinyl acetate copolymer (EVA), a foam of a thermosetting resin such as polyurethane (PU), or a foam of a rubber material such as butadiene rubber or chloroprene rubber can be exemplified. A material having a JIS C hardness of 43° to 50° is preferably used. When the JIS C hardness is less than 43°, the midsole main body becomes too soft, and sinking of the foot becomes large. In addition, the heel portion may be too deformed to sufficiently suppress pronation. On the other hand, when the JIS C hardness of the midsole main body exceeds 50°, sufficient cushioning property may be lost.

Further, the shoe sole main body may be formed by laminating a plurality of members, and in this example, the plurality of members is preferably made of different flexible materials. For example, it is a preferable aspect to use rubber as an outsole in superposition with the above-described material having a JIS C hardness of 43° to 50° as the midsole. When rubber is used as the outsole, improvement in the sustainability of walking performance can be expected. Further, the outsole may be formed of translucent rubber. By using the translucent rubber, the below-described plate can be visually recognized from the external view so that designability of the shoe sole can be enhanced. On the other hand, the outsole may be partially or entirely formed of black rubber using carbon black as a reinforcing filler.

Our shoe sole includes a plate made of a material having a flexural modulus higher than that of the flexible material constituting the shoe sole main body.

The material constituting the plate is not particularly limited as long as the material has a flexural modulus higher than that of the flexible material constituting the shoe sole main body, but it is desirable to use fiber reinforced plastic in particular, because a plate having light weight and moderate rigidity can be obtained. Reinforcing fibers used for the fiber reinforced plastic are not particularly limited, but glass fibers, aramid fibers, polyethylene fibers, silicon carbide fibers, and carbon fibers are preferably used. In particular, the glass fibers and the carbon fibers are preferably used from the viewpoint that a fiber reinforced composite material that is lightweight and has high performance and excellent mechanical characteristics can be obtained.

In addition, each of glass fibers and carbon fibers may solely be used, or both the glass fibers and the carbon fibers may be used for one plate from a balance between performance and cost.

The glass fibers are not particularly limited, but E glass fibers, S glass fibers, C glass fibers, and D glass fibers are preferably used. From the viewpoint of balance between cost and strength, E glass fibers are preferably used. S glass fibers are preferably used when high strength is required, C glass fibers are preferably used when acid resistance is required, and D glass fibers are preferably used when low dielectric constant is required. The average fiber diameter of the glass fibers is not particularly limited, but is preferably 4 to 20 μm, more preferably 5 to 16 μm. The lower limit is not particularly limited, and sufficient effect can be generally obtained when the diameter is 4 μm or more. When the average fiber diameter exceeds 20 μm, the strength tends to decrease.

The areal weight of the glass fiber is preferably 20 to 400 $g/m^2$, and more preferably 40 to 300 $g/m^2$. When the areal weight of the glass fiber is 20 $g/m^2$ or more, the weaving properties of the glass fiber woven fabric are improved. Furthermore, when the areal weight of the glass fiber is 400 $g/m^2$ or less, a glass fiber reinforced composite material is obtained in which the resin easily reaches the central portion in the thickness direction during impregnation of the epoxy resin composition or the like and an unimpregnated portion (void) hardly remains. As a result, excellent mechanical properties such as compressive strength are exhibited. In addition, it is preferable to use the glass fibers after pretreatment with a coupling agent such as an isocyanate-based compound, an organosilane-based compound, an organotitanate-based compound, an organoborane-based compound, or an epoxy compound, from the viewpoint of obtaining more excellent mechanical strength.

Next, the carbon fibers are not particularly limited, but polyacrylonitrile-based carbon fibers, rayon-based carbon fibers, pitch-based carbon fibers and the like are preferably used. Among them, the polyacrylonitrile-based carbon fibers having high tensile strength are preferably used in particular. As the form of the carbon fibers, twisted yarn, untwisted yarn, non-twisted yarn and the like can be used.

Such carbon fibers preferably have a tensile modulus of 180 to 600 GPa. Since the tensile modulus within this range allows the resulting fiber reinforced composite material to have rigidity, the resulting molded article can be reduced in weight. In general, the strength of carbon fibers tends to decrease as the modulus of elasticity increases, but the strength of carbon fibers themselves can be maintained within this range. The modulus of elasticity is more preferably 200 to 440 GPa, and still more preferably 220 to 300 GPa. The range may be a combination of any of the above upper limits and any of the above lower limits. The tensile modulus of the carbon fiber is a value measured in accordance with JIS R7601-2006.

Examples of commercially available products of carbon fibers include "TORAYCA (registered trademark)" T300 (tensile strength: 3.5 GPa, tensile modulus: 230 GPa), "TORAYCA (registered trademark)" T300B (tensile strength: 3.5 GPa, tensile modulus: 230 GPa), "TORAYCA (registered trademark)" T400HB (tensile strength: 4.4 GPa, tensile modulus: 250 GPa), "TORAYCA (registered trademark)" T700SC (tensile strength: 4.9 GPa, tensile modulus: 230 GPa), "TORAYCA (registered trademark)" T800HB (tensile strength: 5.5 GPa, tensile modulus: 294 GPa), "TORAYCA (registered trademark)" T800SC (tensile strength: 5.9 GPa, tensile modulus: 294 GPa), "TORAYCA (registered trademark)" T830HB (tensile strength: 5.3 GPa, tensile modulus: 294 GPa), "TORAYCA (registered trademark)" T1000 GB-(tensile strength: 6.4 GPa, tensile modulus: 294 GPa), "TORAYCA (registered trademark)" T1100GC (tensile strength: 7.0 GPa, tensile modulus: 324 GPa), "TORAYCA (registered trademark)" M35JB (tensile strength: 4.7 GPa, tensile modulus: 343 GPa), "TORAYCA (registered trademark)" M40JB (tensile strength: 4.4 GPa, tensile modulus: 377 GPa), "TORAYCA (registered trademark)" M46JB (tensile strength: 4.2 GPa, tensile modulus: 436 GPa), "TORAYCA (registered trademark)" M55J (tensile strength: 4.0 GPa, tensile modulus: 540 GPa), "TORAYCA (registered trademark)" M60JB (tensile strength: 3.8 GPa, tensile modulus: 588 GPa), "TORAYCA (registered trademark)" M30SC (tensile strength: 5.5 GPa, tensile modulus: 294 GPa) (all manufactured by Toray Industries, Inc.), and PX35 (tensile strength: 4.1 GPa, tensile modulus: 242 GPa) (manufactured by ZOLTEK Corporation).

The number of filaments of the carbon fiber is not particularly limited. However, when using the below-described woven fabric for the plate, the carbon fiber bundle is preferably 1,000 to 70,000 filaments, and more preferably 1,000 to 60,000 filaments, from the viewpoints of weaving productivity, required tensile/flexural modulus and strength of the plate, and designability of the plate.

Next, the form of the reinforcing fibers used in the plate is not particularly limited. However, it is preferable to adopt unidirectional fiber reinforced plastic obtained by aligning the above-described reinforcing fibers in one direction and combining the aligned reinforcing fibers with the below-described matrix resin, or fabric reinforced plastic obtained by processing the above-described reinforcing fibers into a woven fabric and then combining the woven fabric with the below-described matrix resin.

The woven fabric stated above will be described. The weave of the woven fabric is not particularly limited, but plain weave, twill weave, satin weave, rib weave, basket weave, honey-comb weave, huckaback weave, mock leno weave, and crepe weave are preferably used. Examples of the twill weave include three-harness twill, four-harness twill, five-harness twill, six-harness twill, elongated twill, curved twill, broken twill, offset twill, pointed twill, entwining twill, double twill, corkscrew twill, twill check, fancy twill, and shaded twill, and it can be selected in accordance with the designability required for the plate. In addition, examples of the satin weave include five-harness satin, seven-harness satin, eight-harness satin, 10-harness satin, irregular satin, extended satin, double satin, granite weave, satin check, and shaded satin, and it can be selected in accordance with the designability required for the plate. Further, examples of the rib weave include warp rib weave, weft rib weave, and the fancy and figured rib weave, and it can be selected in accordance with the designability required for the plate. Moreover, examples of the basket weave include regular basket weave, fancy and figured basket weave, irregular basket weave, fancy and figured basket weave, and oblique rib weave, and it can be selected in accordance with the designability required for the plate. Furthermore, as the reinforcing fibers constituting a woven fabric, the single glass fibers or the single carbon fibers both of which are exemplified above may be used, or a plurality of different types of the glass fibers or the carbon fibers may be applied. In addition, at least one type of a glass fiber and at least one type of a carbon fiber may be combined and interwoven because of excellent performance, cost, and designability.

Next, a matrix resin that is combined with the reinforcing fibers and constitutes the plate will be described. As the matrix resin, a thermosetting resin or a thermoplastic resin is preferably used.

The thermosetting resin is not particularly limited. However, a thermosetting resin composition selected from an epoxy resin composition, a vinyl ester resin composition, an unsaturated polyester resin composition, and a polyurethane resin composition is preferable from the viewpoint of handleability. An epoxy resin composition, a vinyl ester resin composition, and an unsaturated polyester resin composition are more preferable from the viewpoint of performance and durability of a plate. In addition, the thermosetting resin composition containing them does not need to be a single thermosetting resin composition, and may be mixed with each other, for example, by mixing resin compositions with each other. Examples of the epoxy resin composition include a resin composition containing an epoxy resin such as an aromatic glycidyl ether obtained from phenol having a plurality of hydroxyl groups, an aliphatic glycidyl ether obtained from alcohol having a plurality of hydroxyl groups, a glycidylamine obtained from amine, an epoxy resin having an oxirane ring, and a glycidyl ester obtained from carboxylic acid having a plurality of carboxyl groups. Examples of the aromatic glycidyl ether include diglycidyl ethers obtained from bisphenol such as diglycidyl ethers of bisphenol A, diglycidyl ethers of bisphenol F, diglycidyl ethers of bisphenol AD, diglycidyl ethers of bisphenol S; polyglycidyl ethers of novolac obtained from phenol, alkylphenol or the like; diglycidyl ethers of resorcinol; diglycidyl ethers of hydroquinone; diglycidyl ethers of 4,4'-dihydroxybiphenyl; diglycidyl ethers of 4,4'-dihydroxy-3,3',5,5'-tetramethylbiphenyl; diglycidyl ethers of 1,6-dihydroxynaphthalene; diglycidyl ethers of 9,9'-bis(4-hydroxyphenyl)fluorene; triglycidyl ethers of tris(p-hydroxyphenyl)methane; tetraglycidyl ethers of tetrakis(p-hydroxyphenyl)ethane; and diglycidyl ethers having an oxazolidone skeleton obtained by reacting diglycidyl ether of bisphenol A with bifunctional isocyanate. Examples of the aliphatic glycidyl ether include diglycidyl ethers of ethylene glycol, diglycidyl ethers of propylene glycol, diglycidyl ethers of 1,4-butanediol, diglycidyl ethers of 1,6-hexanediol, diglycidyl ethers of neopentyl glycol, diglycidyl ethers of cyclohexanedimethanol, diglycidyl ethers of glycerin, triglycidyl ethers of glycerin, diglycidyl ethers of trimethylolethane, triglycidyl ethers of trimethylolethane, diglycidyl ethers of trimethylolpropane, triglycidyl ethers of trimethylolpropane, tetraglycidyl ethers of pentaerythritol, diglycidyl ethers of dodecahydrobisphenol A, and diglycidyl ethers of dodecahydrobisphenol F. Examples of the glycidylamine include diglycidylaniline, diglycidyltoluidine, triglycidylaminophenol, tetraglycidyldiaminodiphenylmethane, tetraglycidylxylylenediamine, halogens thereof, alkyl-substituted products thereof, and hydrogenated products thereof. Examples of the epoxy resin having an oxirane ring include oligomers of vinylcyclohexene dioxide, dipentene dioxide, 3,4-epoxycyclohexylmethyl 3,4-epoxycyclohexanecarboxylate, bis(3,4-epoxycyclohexylmethyl) adipate, dicyclopentadiene dioxide, bis(2,3-epoxycyclopentyl) ether, and 4-vinylcyclohexene dioxide. Examples of the glycidyl ester include diglycidyl phthalate, diglycidyl terephthalate, diglycidyl hexahydrophthalate, and dimer acid diglycidyl ester. As for these epoxy resins, the epoxy resin composition does not necessarily contain a single epoxy resin, and a plurality of epoxy resins may be mixed in the epoxy resin composition.

Examples of the vinyl ester resin composition include a resin composition containing a vinyl ester resin such as an epoxy acrylate resin obtained by reacting an epoxy resin with acrylic acid or an epoxy methacrylate resin obtained by reacting an epoxy resin with methacrylic acid. The type of epoxy resin as a raw material of these vinyl ester resins is not particularly limited. However, examples thereof include aromatic glycidyl ethers obtained from phenol having a plurality of hydroxyl groups, aliphatic glycidyl ethers obtained from alcohol having a plurality of hydroxyl groups, glycidylamines obtained from amine, epoxy resins having an oxirane ring, and glycidyl esters obtained from carboxylic acid having a plurality of carboxyl groups. Examples of the aromatic glycidyl ether as a raw material of the vinyl ester resin include diglycidyl ethers obtained from bisphenol such as diglycidyl ethers of bisphenol A, diglycidyl ethers of bisphenol F, diglycidyl ethers of bisphenol AD, diglycidyl ethers of bisphenol S; polyglycidyl ethers of novolac obtained from phenol, alkylphenol or the like; diglycidyl ethers of resorcinol; diglycidyl ethers of hydroquinone; diglycidyl ethers of 4,4'-dihydroxybiphenyl; diglycidyl ethers of 4,4'-dihydroxy-3,3',5,5'-tetramethylbiphenyl; diglycidyl ethers of 1,6-dihydroxynaphthalene; diglycidyl ethers of 9,9'-bis(4-hydroxyphenyl)fluorene; triglycidyl ethers of tris(p-hydroxyphenyl)methane; tetraglycidyl ethers of tetrakis(p-hydroxyphenyl)ethane; and diglycidyl ethers having an oxazolidone skeleton obtained by reacting diglycidyl ether of bisphenol A with bifunctional isocyanate. Examples of the aliphatic glycidyl ether as a raw material of the vinyl ester resin include diglycidyl ethers of ethylene glycol, diglycidyl ethers of propylene glycol, diglycidyl ethers of 1,4-butanediol, diglycidyl ethers of 1,6-hexanediol, diglycidyl ethers of neopentyl glycol, diglycidyl ethers of cyclohexanedimethanol, diglycidyl ethers of glycerin, triglycidyl ethers of glycerin, diglycidyl ethers of trimethylolethane, triglycidyl ethers of trimethylolethane, diglycidyl ether of trimethylolpropane, triglycidyl ethers of trimethylolpropane, tetraglycidyl ethers of pentaerythritol, diglycidyl ethers of dodecahydrobisphenol A, and diglycidyl ethers of dodecahydrobisphenol F. Examples of the glycidylamine as a raw material of the vinyl ester resin include diglycidylaniline, diglycidyltoluidine, triglycidylaminophenol, tetraglycidyldiaminodiphenylmethane, tetraglycidylxylylenediamine, halogens thereof, alkyl-substituted products thereof, and hydrogenated products thereof. Examples of the epoxy resin having an oxirane ring, which is a raw material of the vinyl ester resin, include oligomers of vinylcyclohexene dioxide, dipentene dioxide, 3,4-epoxycyclohexylmethyl 3,4-epoxycyclohexanecarboxylate, bis(3,4-epoxycyclohexylmethyl) adipate, dicyclopentadiene dioxide, bis(2,3-epoxycyclopentyl) ether, and 4-vinylcyclohexene dioxide. Examples of the glycidyl ester as a raw material of the vinyl ester resin include diglycidyl phthalate, diglycidyl terephthalate, diglycidyl hexahydrophthalate, and dimer acid diglycidyl ester.

Examples of the unsaturated polyester resin composition include a resin composition containing an unsaturated polyester resin obtained by reacting saturated dibasic acid having two carboxyl groups and no double bond, with unsaturated dibasic acid having a double bond, and further with dihydric alcohol having two alcoholic hydroxyl groups. The type of saturated dibasic acid as a raw material of the unsaturated polyester resin is not particularly limited, but examples thereof include phthalic anhydride and isophthalic acid. The type of saturated and unsaturated dibasic acid as a raw material of the unsaturated polyester resin is not particularly limited, but examples thereof include maleic anhydride and fumaric acid. The type of dihydric alcohol as a raw material of the unsaturated polyester resin is not particularly limited, but examples thereof include ethylene glycol and propylene glycol.

The above vinyl ester resin composition and unsaturated polyester resin composition may contain a reactive diluent from the viewpoint of handleability, for example, lowering the viscosity. Examples of the reactive diluent include vinyl monomers such as styrene, vinyl toluene, and methyl methacrylate; allyl monomers such as diallyl phthalate, diallyl isophthalate, and triallyl isocyanurate; acrylates such as phenoxyethyl (meth)acrylate, 1,6-hexanediol (meth)acrylate, trimethylolpropane tri(meth)acrylate, and 2-hydroxyethyl (meth)acrylate; vinylpyrrolidone; and phenylmaleimide.

Furthermore, the thermoplastic resin is not particularly limited, but may be an acrylonitrile butadiene styrene (ABS) resin; a polyurethane (TPU) resin; polyesters such as a polyethylene terephthalate (PET) resin, a polybutylene terephthalate (PBT) resin, a polytrimethylene terephthalate (PTT) resin, a polyethylene naphthalate (PEN) resin, and a liquid crystal polyester resin; polyolefins such as a polyethylene (PE) resin, a polypropylene (PP) resin, and a polybutylene resin; and styrene-based resins, as well as a polyoxymethylene (POM) resin; a polyamide (PA) resin; a polycarbonate (PC) resin; a polymethylene methacrylate (PMMA) resin; a polyvinyl chloride (PVC) resin; a polyphenylene sulfide (PPS) resin; a polyphenylene ether (PPE) resin; a modified PPE resin; a polyimide (PI) resin; a polyamide-imide (PAI) resin; polyetherimide (PEI) resin; a polysulfone (PSU) resin; a modified PSU resin; a polyether sulfone resin; a polyketone (PK) resin; a polyether ketone (PEK) resin; a polyether ether ketone (PEEK) resin; a polyether ketone (PEKK) resin; a polyarylate (PAR) resin; a polyether nitrile resin; a phenol-based resin; a phenoxy resin; fluorine-based resins such as a polytetrafluoroethylene resin; and further, thermoplastic elastomers or the like such as a polystyrene-based resin, a polyolefin-based resin, a polyurethane-based resin, a polyester-based resin, a polyamide-based resin, a polybutadiene-based resin, a polyisoprene-based resin, and a fluorine-based resin; copolymers thereof; modified products thereof; and resins obtained by blending two or more of these resins.

In particular, a polymethylene methacrylate (PMMA) resin, a polyurethane (TPU) resin, a polyethylene terephthalate (PET) resin, a polybutylene terephthalate (PBT) resin, an acrylonitrile butadiene styrene (ABS) resin, a polyamide (PA) resin (PA6, PA66, PA12 in particular), a polycarbonate (PC) resin, and a PC/ABS resin obtained by blending polycarbonate (PC) and an acrylonitrile butadiene styrene (ABS) resin are preferably used from the viewpoint of easy processability into the plate, required tensile/flexural modulus and strength of the plate, and designability of the plate.

When coloring is required as one of the designability of the plate, the color is not particularly limited, but the designability can be enhanced by coloring the thermoplastic resin exemplified above black, red, yellow, green, blue, purple, brown or the like.

Next, a fiber reinforced plastic plate (hereinafter, referred to as "FRP mother plate") as a base of the plate will be described. The method of obtaining the plate is not particularly limited, but the FRP mother plate having an area larger than that of the plate is processed into the size of the plate using a machining center, a running saw, a table saw, or a water jet.

The FRP mother plate will be described. The FRP mother plate is fiber reinforced plastic in which the above-described reinforcing fibers and matrix resin are combined and integrated, and unidirectional fiber reinforced plastic in which the above-described reinforcing fibers are aligned in one direction and combined with the above-described matrix resin or fabric reinforced plastic in which the above-described reinforcing fibers are processed into the above-described woven fabric and then combined with the above-described matrix resin is preferably used. The ratio of the reinforcing fibers contained in the unidirectional fiber reinforced plastic or the fabric reinforced plastic is not particularly limited, but 5 to 70% of the fiber volume content (Vf) is preferably used in accordance with the required rigidity, strength, and cost, and 20 to 70% is preferably used when high rigidity and high strength are required. Note that the fiber volume content in an example where a plurality of reinforcing fibers is applied to one type of unidirectional fiber reinforced plastic or one type of fabric reinforced plastic is calculated by adding the fiber volume content of the plurality of reinforcing fibers.

In the first place, a method of manufacturing an FRP mother plate when a thermosetting resin is applied to a matrix resin will be described. First, the above-described reinforcing fibers are aligned in one direction, or the above-described reinforcing fibers are processed into the above-described woven fabric, and then a prepreg impregnated with resin is manufactured. A method of impregnating resin includes a wet method, a hot melt method, extrusion, spraying, printing, or other known methods, and a prepreg can be manufactured by using these methods. In the wet method, a prepreg can be obtained by dissolving resin in an organic solvent selected from acetone, methyl ethyl ketone, methanol and the like to lower the viscosity, impregnating the reinforcing fibers with the resin, then pulling up the reinforcing fiber, and evaporating the organic solvent using an oven or the like. In the hot melt method, a method of directly impregnating the reinforcing fibers with a matrix resin whose viscosity has been lowered by heating, a method of first preparing a release paper sheet with a resin film in which a release paper or the like is once coated with a matrix resin (hereinafter, such release paper sheet may be referred to as "resin film"), then superimposing the resin film(s) on the reinforcing fiber side from both sides or one side of the reinforcing fibers, and heating and pressurizing the resin film(s) to impregnate the reinforcing fibers with the matrix resin or the like can be used. Examples of a method of manufacturing a prepreg by a hot melt method include the following methods. That is, the first method is a so-called one step impregnation hot melt method in which a resin film(s) containing a resin composition is impregnated with a matrix resin in one step by heating and pressurizing the resin film(s) from both sides or one side. The second method is a multi-step impregnation hot melt method in which a resin film is coated with a matrix resin in multi-step, and is impregnated by heating and pressurizing the resin film(s) from both sides or one side. The thickness of one prepreg obtained by impregnating reinforcing fibers with resin is not particularly limited, but is preferably 0.05 mm to 5 mm, and more preferably 0.05 mm to 3 mm from the viewpoint of weight reduction and thickness reduction.

Next, one or more prepregs obtained by the above-described manufacturing methods are laminated to manufacture prepreg laminate. At this time, a single prepreg in which reinforcing fibers are aligned in one direction or a single prepreg in which reinforcing fibers are processed into a woven fabric may be used, or both prepregs may be used in combination. In addition, each lamination angle can be freely selected in accordance with the thickness of the plate in addition to the required rigidity and strength. For example, to exhibit high rigidity and strength in one direction, it is preferably used to laminate the layers in substantially matching with the other layers and, for example, to simultaneously exhibit performance suitable for torsional load and deformation, it is also preferably used to laminate the layers in a direction different from at least one other layer by 10° to 90°. The thickness of the prepreg laminate is not particularly limited, but 0.05 mm to 5 mm is preferably used, and 0.05 mm to 3 mm is more preferably used from the viewpoint of weight reduction and thickness reduction.

The prepreg laminate is heated and pressurized as necessary by press molding, autoclave molding, oven molding, and vacuum-assisted oven molding to cure the matrix resin, whereby the FRP mother plate can be obtained.

In the second place, a method of manufacturing an FRP mother plate when a thermoplastic resin is applied to a matrix resin will be described. First, after the above-described reinforcing fibers are aligned in one direction, a prepreg can be manufactured by a melting method, a powder method, a resin film impregnation method, a commingling method, or other known methods. The melting method is a method in which a thermoplastic resin is melted by an extruder, and reinforcing fibers are passed through a melting bath to impregnate the inside of a fiber bundle with resin. In a solvent method, the inside of a fiber bundle is impregnated with a solution obtained by dissolving resin in a solvent. In the powder method, powder of thermoplastic resin is attached to reinforcing fibers, and the reinforcing fibers are melted and impregnated by heating. By this manufacturing process, a prepreg in which reinforcing fibers are aligned in one direction can be manufactured. On the other hand, at least one woven fabric obtained by processing reinforcing fibers into the above-described woven fabric and at least one matrix resin obtained by processing reinforcing fibers into a film shape are simultaneously placed in a pressurizing equipment (so-called press) having a heated metal board surface, and the woven fabric is impregnated with the film-shaped resin by heating and pressurization, whereby a woven fabric prepreg can be manufactured. The thickness of one prepreg obtained by impregnating reinforcing fibers with resin is not particularly limited, but is preferably 0.05 mm to 5 mm, and more preferably 0.05 mm to 3 mm from the viewpoint of weight reduction and thickness reduction.

Next, one or more prepregs obtained by the above-described manufacturing methods are laminated to manufacture prepreg laminate. At this time, a single prepreg in which reinforcing fibers are aligned in one direction or a single prepreg in which reinforcing fibers are processed into a woven fabric may be used, or both prepregs may be used in combination. In addition, each lamination angle can be freely selected in accordance with the thickness of the plate in addition to the required rigidity and strength. For example, to exhibit high rigidity and strength in one direction, it is preferably used to laminate the layers in substantially matching with the other layers and, for example, to simultaneously exhibit performance suitable for torsional load and deformation, it is also preferably used to laminate the layers in a direction different from at least one other layer by 10° to 90°. The thickness of the prepreg laminate is not particularly limited, but 0.05 mm to 5 mm is preferably used, and 0.05 mm to 3 mm is more preferably used from the viewpoint of weight reduction and thickness reduction.

The prepreg laminate is integrated by being heated and pressurized as necessary by press molding, autoclave molding, oven molding, and vacuum-assisted oven molding, and then cooled, whereby the FRP mother plate can be obtained.

The length and width of the plate can be adjusted in accordance with a desired resiliency, but the length may also affect walking comfort. The length of the plate is preferably 2 to 10 cm, and more preferably 4 to 8 cm.

Figure 15:
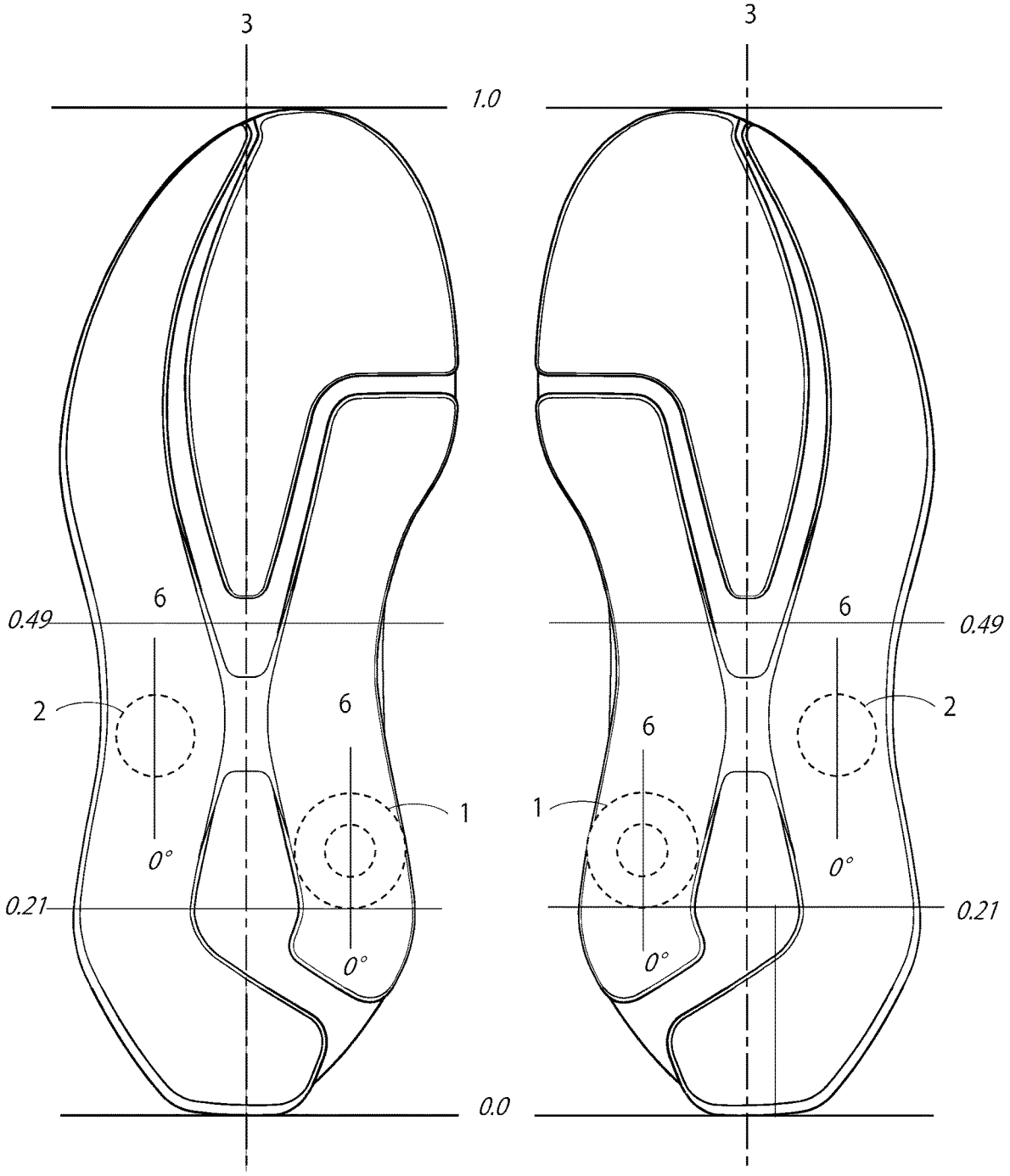
FIG. 15 is a transparent bottom view illustrating another example of a shoe sole.
Figure 16:
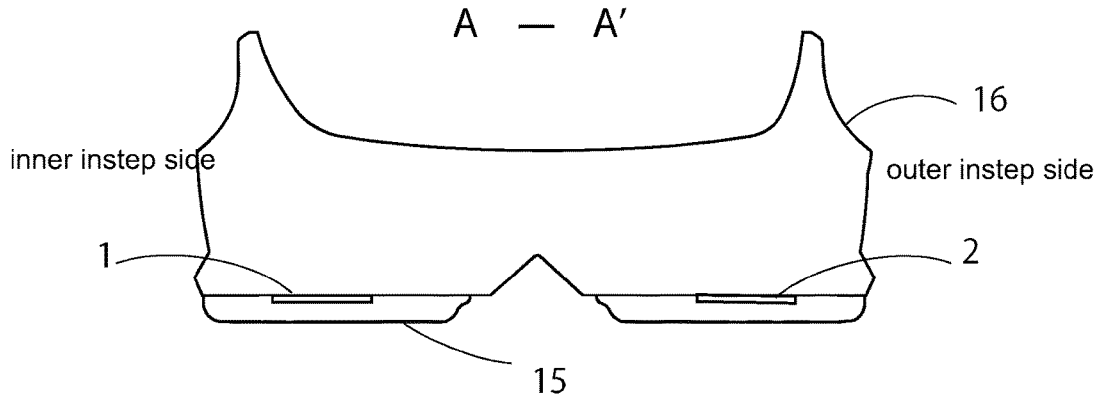
FIG. 16 is a cross-sectional view taken along line A-A' of the shoe sole of FIG. 2.

In addition, the plate may have any shape, and examples of variations thereof are as illustrated in FIGS. 3 to 7 and FIGS. 9 to 15, including a rectangle, an arch, an ellipse, a circle, a triangle, an equilateral triangle, a wedge, a trapezoid, an arc, and a crescent. As illustrated in FIG. 15, the plate may have a circular shape, but in this example, the angle formed between the long axis of the plate and the PCL is regarded as 0°. In particular, the shape of the plate is preferably a rectangle since the resiliency can be effectively obtained even with a small plate, and in the rectangle, the ratio represented by the length of the long side/the length of the short piece is desirably 2.0 to 5.0, and more desirably 3.0 to 4.0. That is, when the ratio is 2.0 or more, it is more difficult to feel smooth weight movement to the forefoot by the plate, and when the ratio is 5.0 or less, sufficient strength against deformation in the foot width direction can be obtained. The corners of the rectangle may be rounded. In addition, the two plates satisfying Condition 1 to Condition 3 are desirably rectangles having widths substantially equal to each other.

The stability of the plate can be adjusted by such that the plates are brought close to each other, or disposed away from each other on the inner instep side and the outer instep side of the shoe sole peripheral portion made of a flexible material. In particular, it is preferable to dispose the two plates away from each other on the inner instep side and the outer instep side of the shoe sole peripheral portion, and when the longer edge of the plate is disposed to be fitted to the shoe sole peripheral edge or disposed to be aligned to the edge of the soft sole material at a small interval of about 0.5 to 1 cm, higher stability can be obtained.

The plate is preferably a plate made of fiber reinforced plastic, having a rectangular shape or a rectangular shape with rounded corners both of which having a width of 1 to 2 centimeters and a length of 6 to 8 centimeters, in which reinforcing fibers are arranged in parallel to long sides of the rectangular shape, and the reinforcing fibers are preferably continuous from one short side to the other short side of the plate. The use of such a plate is preferable because the specific strength can be maximally utilized, and the plate can be prepared easily and without waste.

Figure 9:
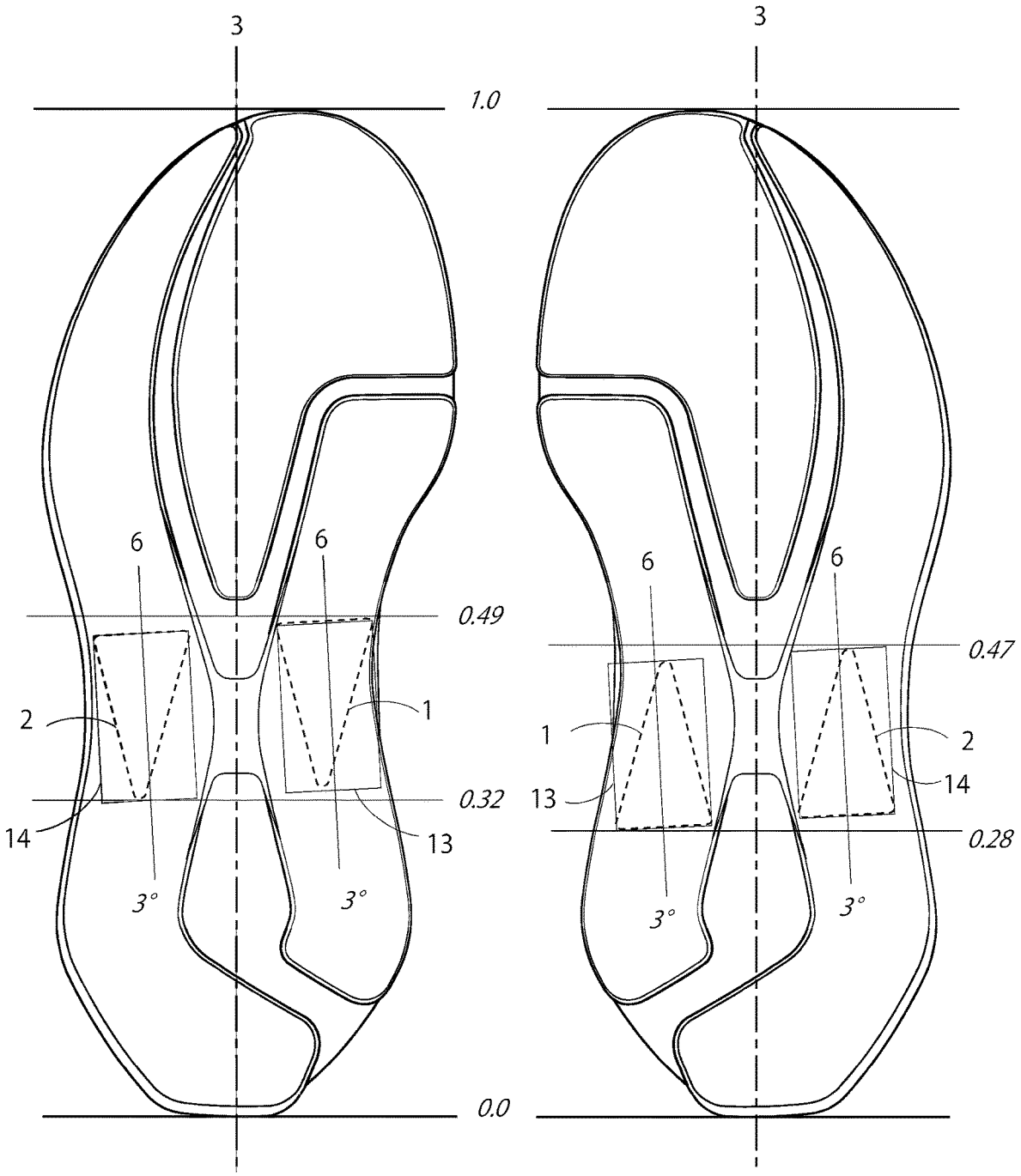
FIG. 9 is a transparent bottom view illustrating another example of a shoe sole.
Figure 10:
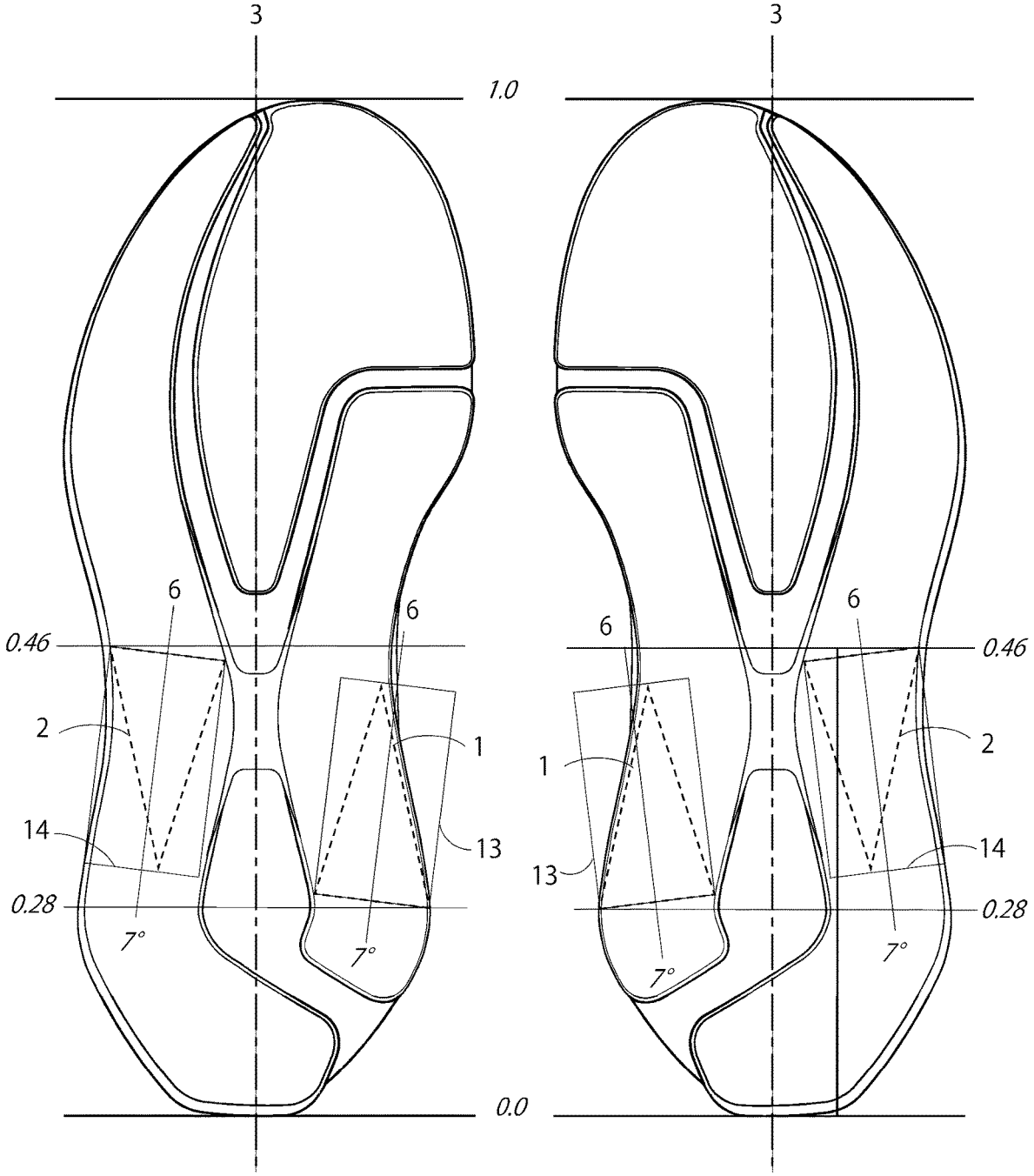
FIG. 10 is a transparent bottom view illustrating another example of a shoe sole.
Figure 11:
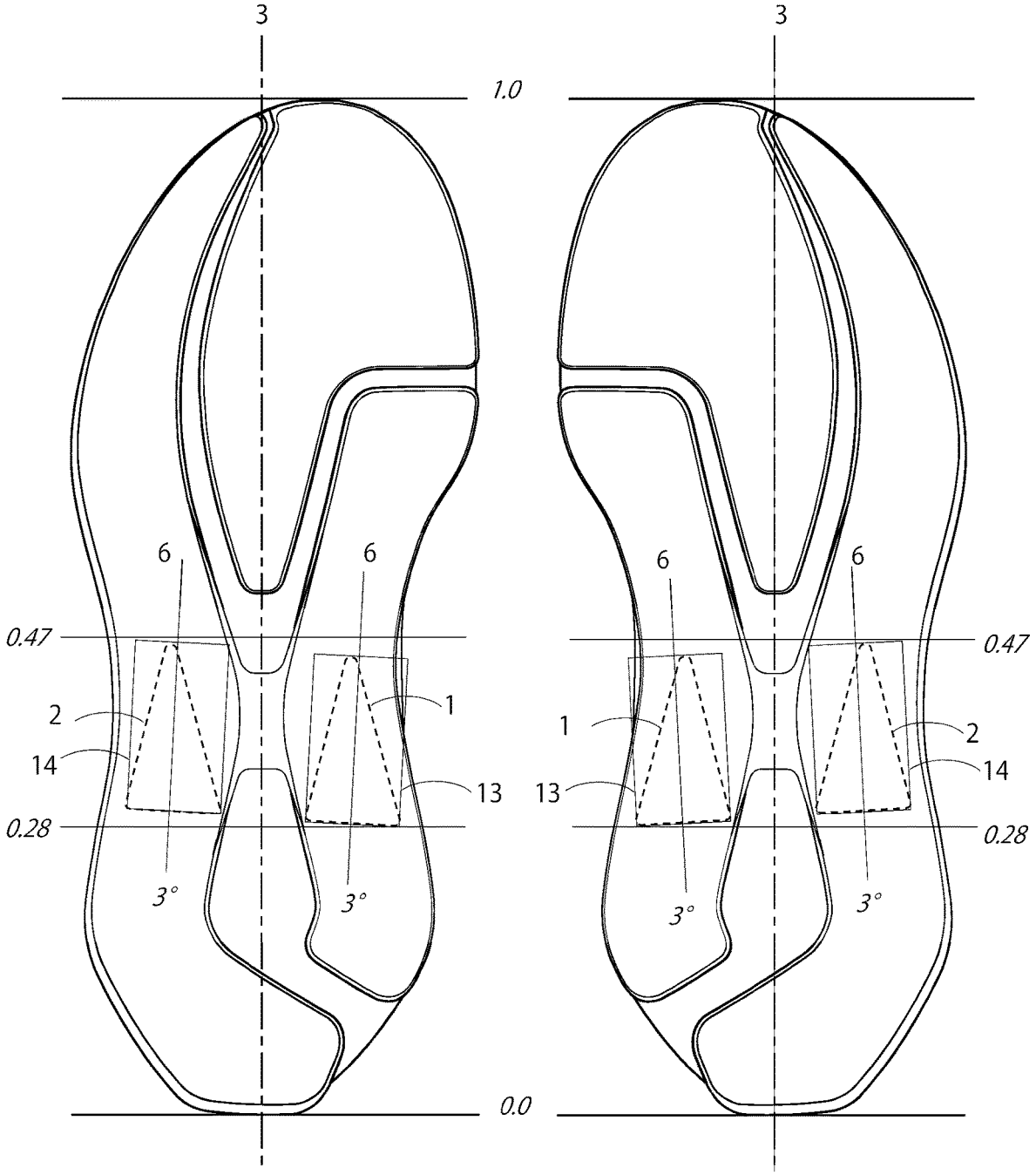
FIG. 11 is a transparent bottom view illustrating another example of a shoe sole.
Figure 12:
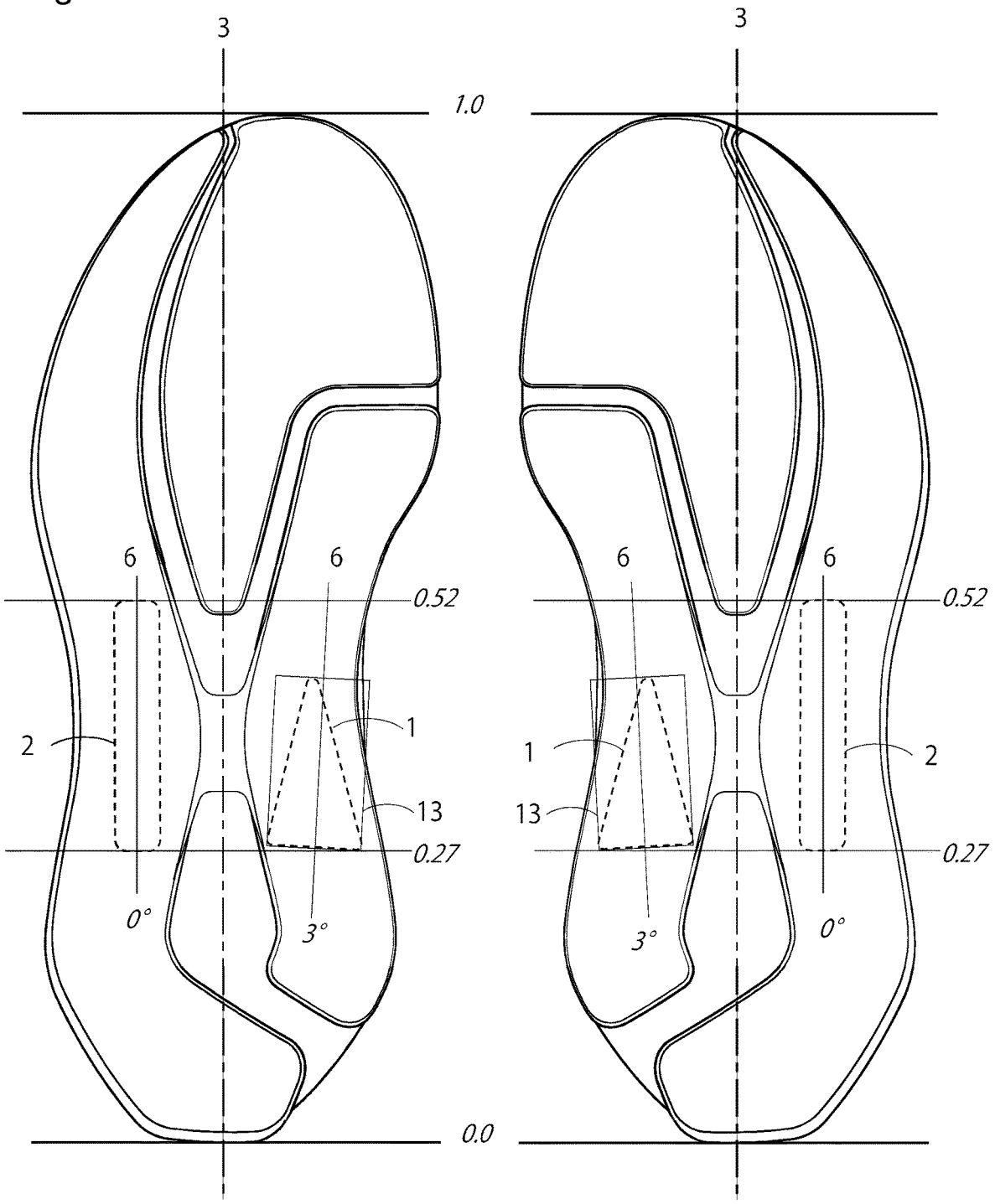
FIG. 12 is a transparent bottom view illustrating another example of a shoe sole.
Figure 13:
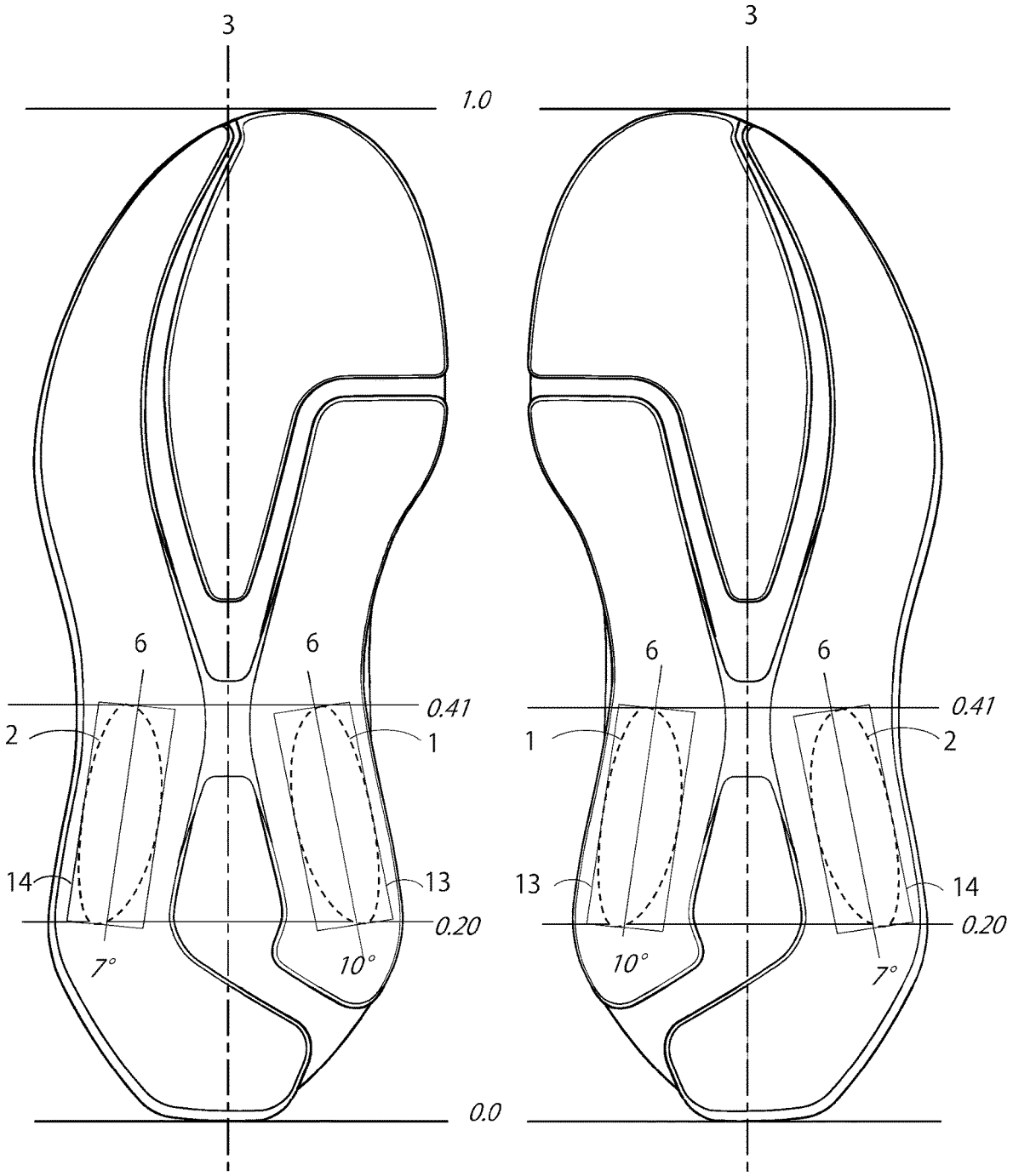
FIG. 13 is a transparent bottom view illustrating another example of a shoe sole.
Figure 14:
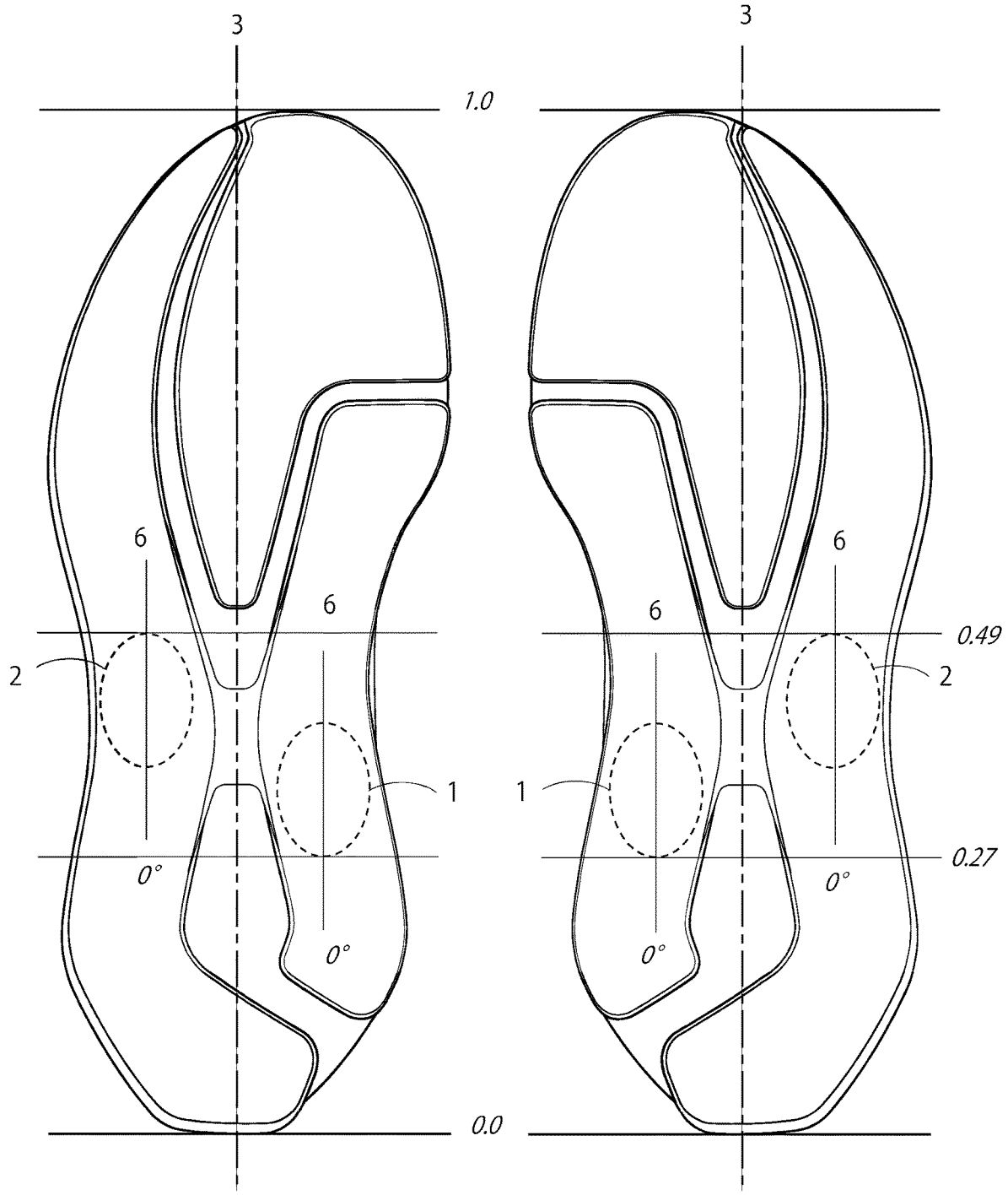
FIG. 14 is a transparent bottom view illustrating another example of a shoe sole.

In addition, as illustrated in FIGS. 9 to 12, a triangular shape is also a preferable aspect as a shape of the plate. The use of plates having a triangular shape can increase or decrease the level of stability throughout the gait cycle. Specifically, different actions are exerted depending on whether the apex of the triangle is disposed toward the toe or the heel. Furthermore, the direction of the apex of the triangle may be changed between the right foot and the left foot. In golf shoes and baseball shoes for right-handed players, as illustrated in FIG. 9, when the right foot is disposed with the apex of the triangle facing the toe, and the left foot is disposed with the apex of the triangle facing the heel, the body movement involving the rotational movement can be efficiently supported.

As illustrated in FIG. 15, the plate may have a hole. The shape of the hole is not particularly limited whether it is a round hole or a slot hole, but since the rigidity of the plate is lowered by forming a hole, the rigidity can be adjusted.

The shoe sole has at least two plates. A plurality of plates having the same shape may be used, or plates having different shapes may be combined. The number of plates may be three or more, but is preferably two because the manufacturing process can be simplified.

Two plates of the at least two plates satisfy all of the following Condition 1 to Condition 3. When three or more plates are used, it is not necessary that the following conditions are satisfied in all combinations of two plates selected from three or more plates, and it is only required that one of the combinations of two plates satisfies the following conditions.

Figure 19:
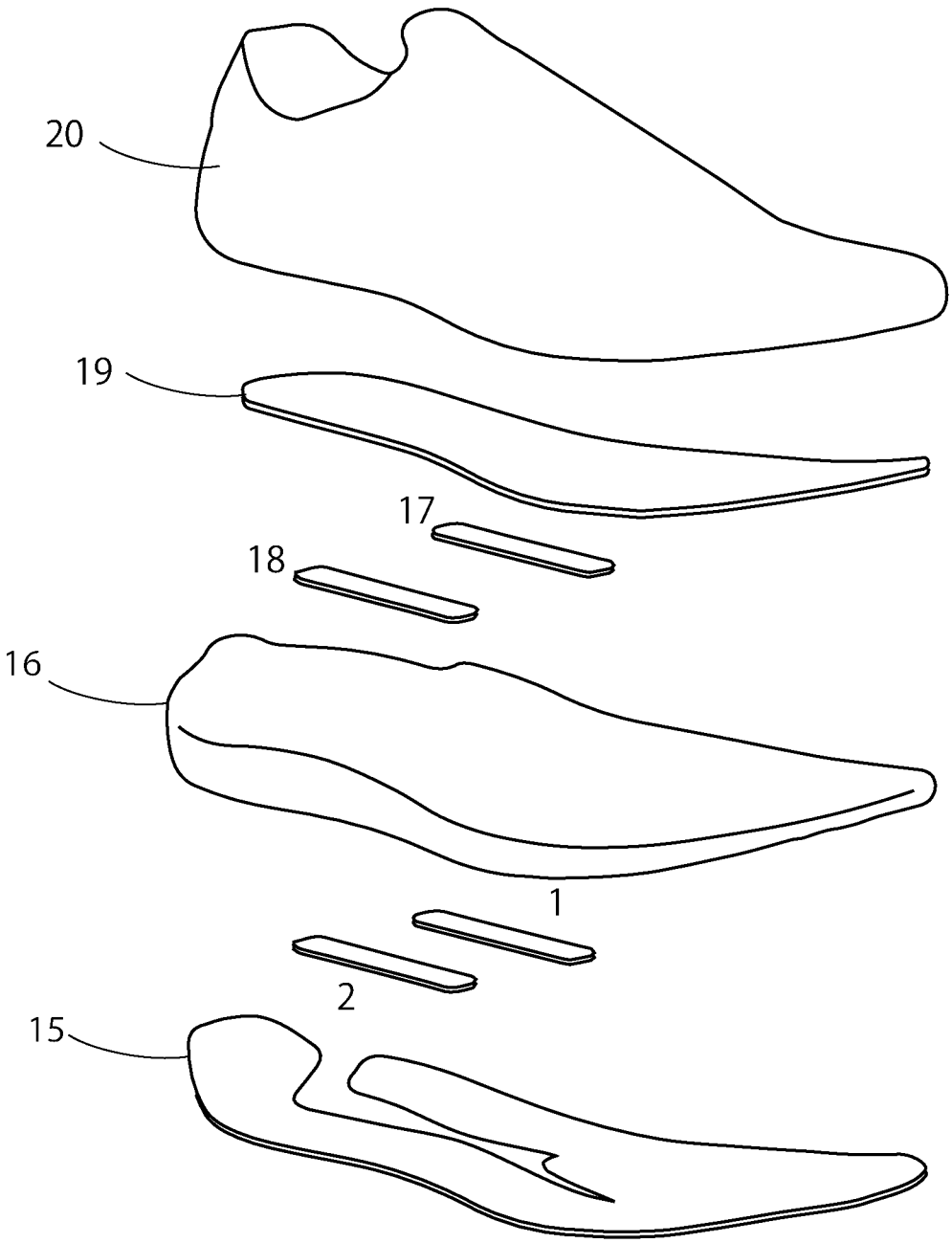
FIG. 19 is an exploded view illustrating the structure of a shoe using a shoe sole.

FIG. 19 illustrates an example in which four plates are combined. Two quadrangular plates are each disposed above and below in parallel (0°) with respect to the PCL with a midsole 16 interposed therebetween. An outsole 15 is laminated on the ground side of the midsole, and an insole 19 is laminated on the sole side of the foot. In addition, an upper 20 is illustrated as a reference of a mode of use of the shoe sole. The two plates on the ground side (a first plate 1 and a second plate 2) act like a core under a soft midsole and help smooth weight movement of the wearer. On the other hand, the two plates on the sole side of the foot (third plate 17 and fourth plate 18) suppress excessive deformation of the arch of the foot of the wearer and help the wearer's gait less prone to feeling fatigue.

The shoe sole satisfies the following three Condition 1 to Condition 3:

Condition 1: In a transparent bottom view of a shoe sole, with respect to a last center line (PCL), one of the two plates is disposed on an inner instep side, and the other plate is disposed on an outer instep side.

Condition 2: Long axes of the two plates both form an angle in a range of 0° to 30° with respect to the PCL.

Condition 3: When a tip of the shoe sole on a toe side is 1 and a tip of the shoe sole on a heel side is 0, both of the two plates are present entirely in a region of 0.2 to 0.7. Alternatively, Condition 3 can be expressed such that the shoe sole main body has a toe end tip and a heel end tip, wherein a length of the shoe sole main body is measured from the heel end tip to the toe end tip, wherein both of the two plates of the at least two plates are entirely disposed in a region of the length beginning at 20% of the length and terminating at 70% of the length, as measured in a direction from the heel end tip towards the toe end tip.

The last center line (PCL: the last center line may be abbreviated to "PCL" as an abbreviation of Profile Center Line) in the transparent bottom view of the shoe sole is obtained as a center line of a last (wooden form) bottom face gauge. Further, as illustrated in FIG. 1, the angle formed by the PCL and the long axis of the plate is obtained as follows. That is, when the shoe sole is viewed from above, the angle is obtained as an angle formed by the long axis of the plate, namely, the center line of the plate, and the PCL. When both are parallel to each other, the angle shall be zero degrees. The center line of the plate refers to a line connecting the midpoints of the short sides of the circumscribed rectangle having the smallest area enclosing the plate. When one end of the center line of the plate on the short side of the circumscribed rectangle is P1, the other end of the center line of the plate on the short side of the circumscribed rectangle is P2, a distance between P1 and P2 is L1, a distance between P1 and the PCL is LP1, and a distance between P2 and the PCL is LP2, an angle θ formed by the long axis of the plate, namely, the center line of the plate, and the PCL is obtained from Equation (1):

$$\sin\theta = |LP1 - LP2| / L1 \quad (1).$$

When viewed from the PCL, the side on which the thumb is placed is the inner instep side, and the side on which the little finger is placed is the outer instep side.

Further, as illustrated in FIG. 1, the tip of the toe side and the tip of the heel side are obtained as follows. That is, the contact point of the line contacting the transparent bottom view of the shoe sole on the toe side of the perpendiculars to the PCL is defined as the tip on the toe side, and the contact point of the line contacting the transparent bottom view on the heel side of the perpendiculars to the PCL is defined as the tip on the heel side. When lines contact each other, the center of the contact portion is used as the contact point. Alternatively, when two or more contact points are observed on the toe side or the heel side, the contact point on such side that is a constituent of a combination of contact points in which the distance between the intersections of the perpendicular including the contact point and the PCL is maximized is adopted, and when the distances are the same, the contact point closer to the PCL is adopted.

When the tip of the shoe sole on the toe side is 1 (in the drawings, represented by "1.0") and the tip of the shoe sole on the heel side is 0 (in the drawings, represented by "0.0"), the two plates of the at least two plates both are entirely present in a region of 0.2 to 0.7. To avoid confusion with reference signs in the drawings, the above numerals in each of the drawings are expressed including decimal places and in italics. Among them, the two plates are preferably present in a manner that one end is in a region of 0.4 to 0.7 and the other end is in a region of 0.2 to 0.4. That is, when a point in the XY coordinate system in which the PCL is the Y axis and a straight line orthogonal to the PCL and passing through the tip on the heel side is the X axis is represented by (x, y), the y coordinate value of the tip on the toe side is 1 and the y coordinate value of the tip on the heel side is 0, and any part of the two plates is not present at a point exceeding 0.7 as the y coordinate value and a point less than 0.2 as the y coordinate value. Preferably, the two plates have a y-coordinate value of 0.4 to 0.7 at one end and a y-coordinate value of 0.2 to 0.4 at the other end. The end of the plate means a portion where the y coordinate value on the plate is maximum and a portion where the y coordinate value on the plate is minimum.

The heel portion and the tip portion are not provided with a special material or structure, and only the region of the midfoot portion is limitedly supported so that the entire sole structure can be reduced in weight.

Describing Condition 3, the cushion of the heel portion of the sole structure is compressed and deformed by absorbing impact from the ground at the time of landing. However, since one of the ends of the plate is disposed at the position where the y coordinate value is 0.2 or more, even when the heel of the foot is about to fall in the lateral direction by pronation or supination at the time of heel landing, the compression and deformation is less likely to occur at the heel portion toward the midfoot portion so that such lateral shakes of the heel can be prevented. Furthermore, the stability in weight movement from the time of heel landing to the forefoot portion is also improved at the same time. If a part of the plate is present at a position less than 0.2 as the y coordinate value, a sense of push-up may be felt at the time of landing. In addition, since one of the ends of the plate is disposed at a position where the y coordinate value is 0.7 or less, the foot can move away from the ground without hindering dorsiflexion of the toe portion, especially the MP joint, at the time of kicking a foot subsequent to the weight movement to the forefoot portion. When a part of the plate is present at a position exceeding 0.7 as the y coordinate value, the plate starts to be caught in the portions below the MTP joints, and especially for a beginner runner who does not have sufficient muscle strength of plantaris, there is an instance where the runner feels uncomfortable in the toe portion or the plate hinders the natural dorsiflexion. Accordingly, the plate is essential to be in this range. As described above, the two elongated plates disposed substantially parallel to the midfoot portion serve as a kind of guidance system such as parallel skiing only when the midfoot portion is grounded, and even a beginner runner can achieve stable weight movement with lightweight shoes while suppressing over pronation.

In addition, describing Condition 2, satisfaction of Condition 2 enables stabilization of an ankle joint by suppressing pronation and supination of the ankle joint from the time of heel landing to the time of foot release as well as enabling the quick weight movement at the time of forward movement. The angle formed by the long axis of the plate with respect to the PCL is desirably 0° to 10°, and more desirably 0° to 3°. On the other hand, when a side step or an oblique direction change is required, the angle formed by the long axis of the plate with respect to the PCL may be an angle of 10° to 30°. In particular, in making the angle large, the plates are preferably disposed along the edge of the peripheral portion of the shoe sole made of a flexible material, with the left and right shoes being a mirror image. In disposing the plates along the periphery of the shoe sole in the angle of 30°, it can be suitably used in sports involving lateral or oblique movements such as basketball, handball, or soccer. When the angle formed by the long axis of the plate with respect to the PCL exceeds 30°, the stability in suppression of lateral shakes is poor.

In addition, when the interval between the two plates is too narrow, stability may be lost. The distance between the center of gravity of the plate and the PCL is preferably 1.0 cm to 4.0 cm, and more desirably 2.5 cm to 3.5 cm.

Furthermore, the shape of the shoe sole is not particularly limited, and the effect of stabilization can be widely expected even for shoes having a shoe sole thickness that is not particularly oversized (thick sole shoes) such as flat shoes, traditional leather shoes. Among them, it is desirable to have a rocker shape in applications where it is required to move forward more easily. The rocker shape means a shape in which either or both top (toe portion) and tail (rear portion) are lifted without the uplift in the midfoot portion. Since there are few grounded surfaces, it is easy to move forward, and since the toe is lifted in the air, it is easy to change the direction. Conventionally, there has been a rocker shaped shoe, but due to not having a "core," there is a problem in durability of the shoe sole, or a problem in that the foot is unstable while the shoe offering easy forward movement. Both durability and stability can be improved by putting a plate serving as a core.

Figure 20:
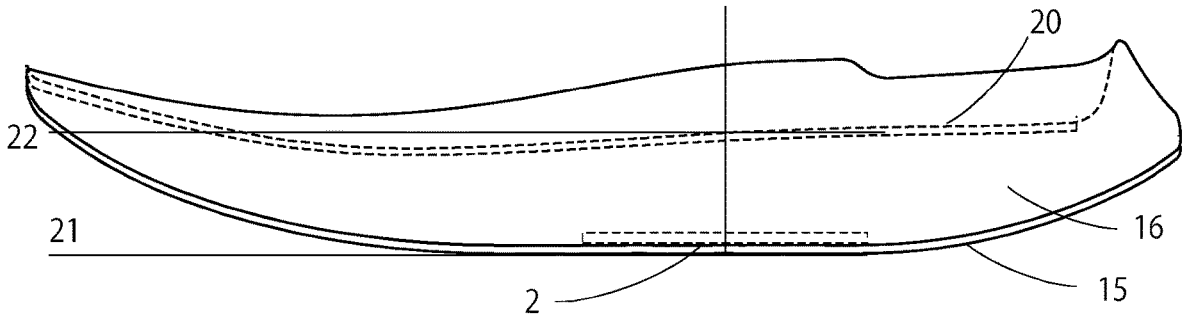
FIG. 20 is a transparent side view of the shoe sole of FIG. 2 as viewed from an outer instep side.
Figure 22:
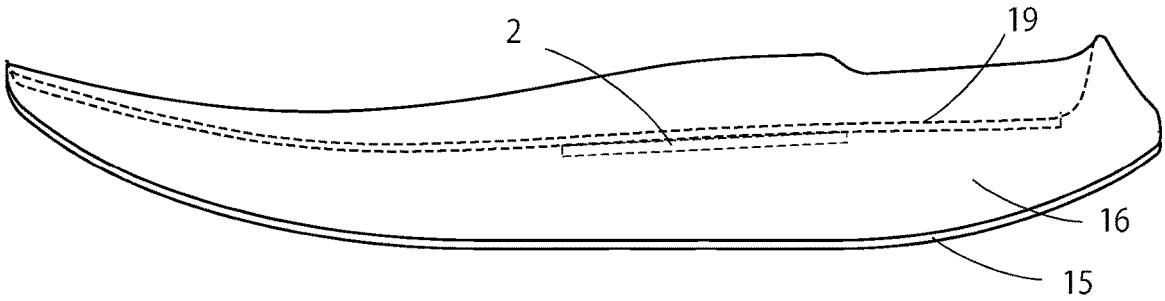
FIG. 22 is a transparent side view of a shoe sole viewed from an outer instep side, illustrating the placement of the plate in the shoe sole height direction.
Figure 23:
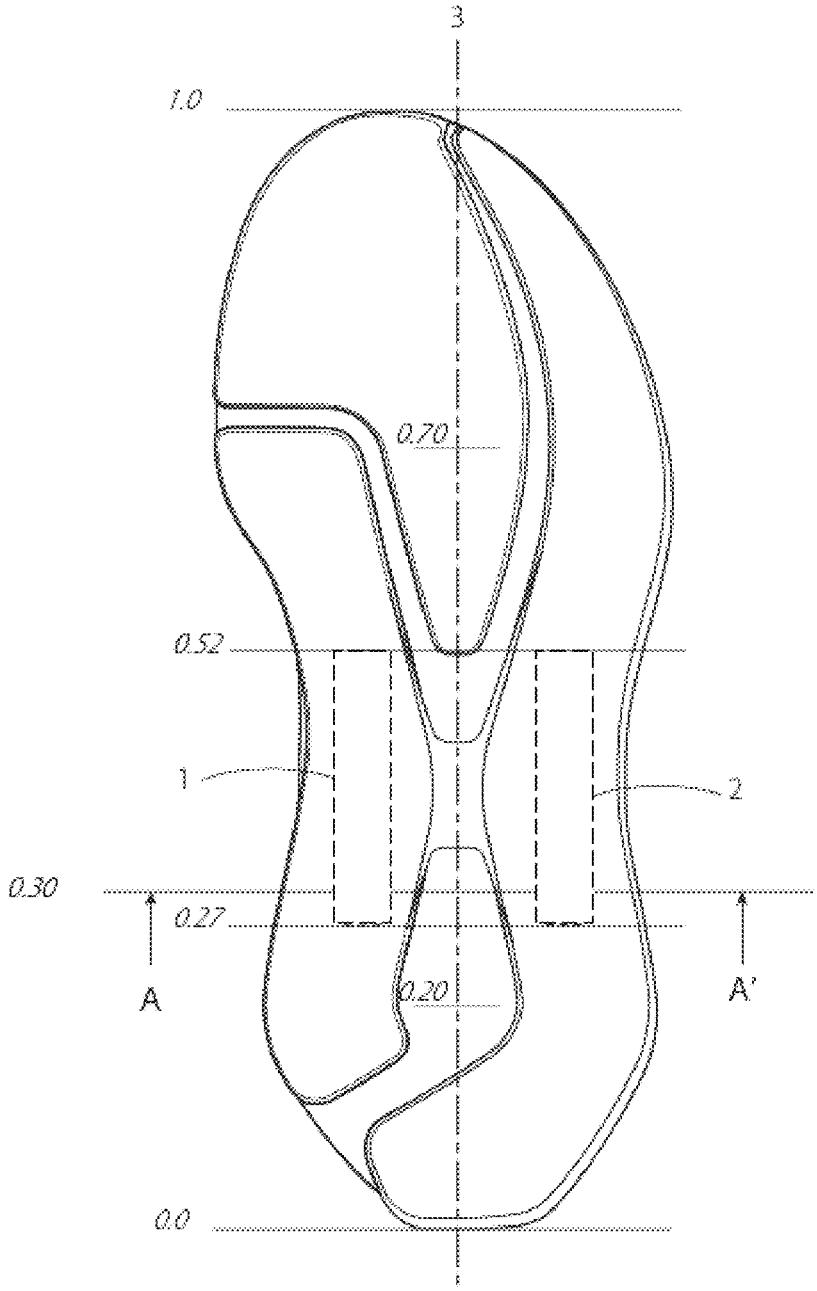
FIG. 23 is a transparent bottom view illustrating an example of a shoe sole, showing a rectangular plate with squared corners.

In addition, in the shoe sole, there is particularly no restriction on the placement in the height direction in the shoe sole of the two plates satisfying Condition 1 to Condition 3, and there is a plurality of options. One example thereof is a contact surface with the ground, and other examples thereof include a position between the outsole 15 and the midsole 16 as illustrated in FIG. 20, a position of a lower half of the midsole, a position of an upper half of the midsole, and a position between the midsole 16 and an insole 19 as illustrated in FIG. 22. As the placement position of the plate in the height direction increases, the plate approaches the sole of a person so that the action of stabilizing the arch of the foot increases. Conversely, as the plate approaches the ground, the stability of the shoe at the time of grounding increases. Therefore, the placement of the plate can be adjusted depending on which function is prioritized. In terms of improving the stability between the ground and the shoe, as illustrated in FIG. 20, when the thickness of the shoe sole is H in a cross-sectional view in a vertical cross section of the shoe sole including the center of gravity of the plate, the plate is desirably disposed in a range of 0.05×H or more and 0.5×H or less. Further, both of the two plates are preferably disposed in this range. The distance from the shoe sole bottom face to the plate being 0.05×H or more of the thickness of the shoe sole in the cross section can prevent the plate from being damaged by impact from the ground, pebbles, or the like. Such distance being 0.5×H or less enables stable absorption of impact from the ground. Alternatively, the disposition of the plate can be expressed such that the shoe sole has a height defined by and between a top-most point of the shoe sole and a bottom-most point of the shoe sole, wherein both of the two plates of the at least two plates are disposed in a vertical region of the height beginning at 5% of the height and terminating at 50% of the height, as measured in a direction from the bottom-most point toward the top-most point. The distances from a shoe sole bottom face to the two plates may be the same or different. However, preferably, the plate on the inner instep side (arch side) is set slightly higher for a person with over pronation in which the heel is excessively inwardly rotated at the time of landing, or the plate on the outer instep side (outer side of the foot) is set higher for a person with under pronation in which the heel falls to the opposite side. Note that the thickness H of the shoe sole is obtained for each plate at a location where the center of gravity of the plate whose placement position in the shoe sole height direction is to be obtained is present.

Figure 18:
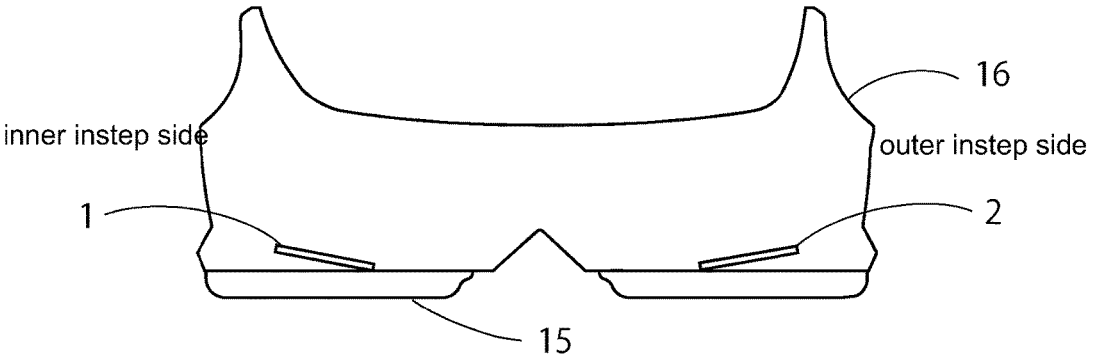
FIG. 18 is a cross-sectional view of another example of a shoe sole.

The edge of the plate may be disposed inclined with respect to the ground. For example, as illustrated in FIG. 18, the height of the outer instep side is set higher toward the outside and, on the other hand, the inner instep side is also disposed slightly higher toward the outside, whereby the stability can be further enhanced. The edge may be vertical to the ground. In this way, the amount of the plate can be reduced, and even a plate having a narrow width can exert high rigidity and efficiently obtain stability.

Figure 21:
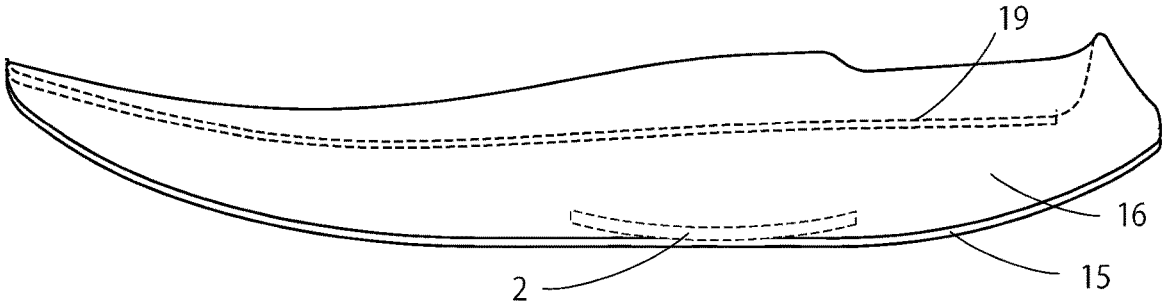
FIG. 21 is a transparent side view of a shoe sole viewed from an outer instep side, illustrating a state in which a plate having a bulging shape with respect to the ground is disposed.

The plate may have a flat shape, but at least one of the plates preferably has a bulging shape with respect to the ground as illustrated in FIG. 21. The shape bulging with respect to the ground means a shape having a curved surface protruding toward the ground side, and an arch shape is also included therein. With such a shape, an area that receives a reaction from the ground at the time of movement can be reduced, thereby facilitating easy forward movement.

Figure 17:
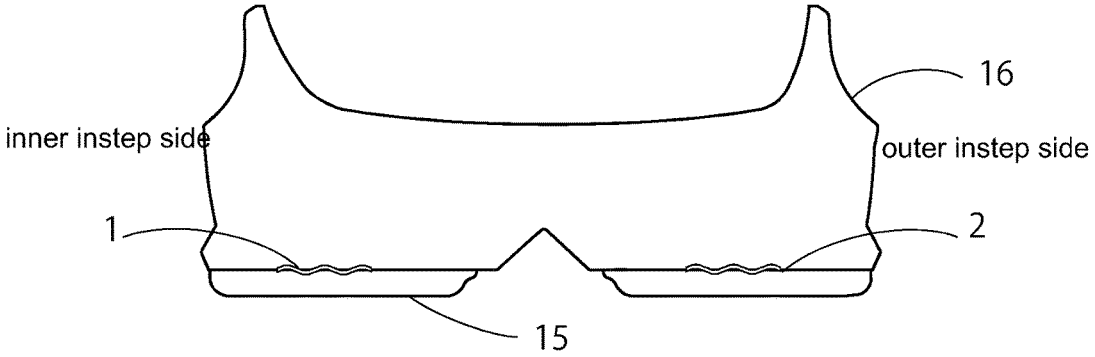
FIG. 17 is a cross-sectional view of another example of a shoe sole.

In addition, at least one of the plates desirably has a corrugated shape as illustrated in FIG. 17. The corrugated shape refers to a shape having a plurality of protrusions and recesses arranged in parallel, and can be usually formed by press working or roll forming. By imparting a corrugated shape to the plate, a thin and strong structure can be formed. Moreover, by increasing the bonding area with the material of the midsole or the outsole, durability against displacement of the shoe in the horizontal direction particularly increases, and durability of the entire sole can be improved.

Example 1

Figure 2:
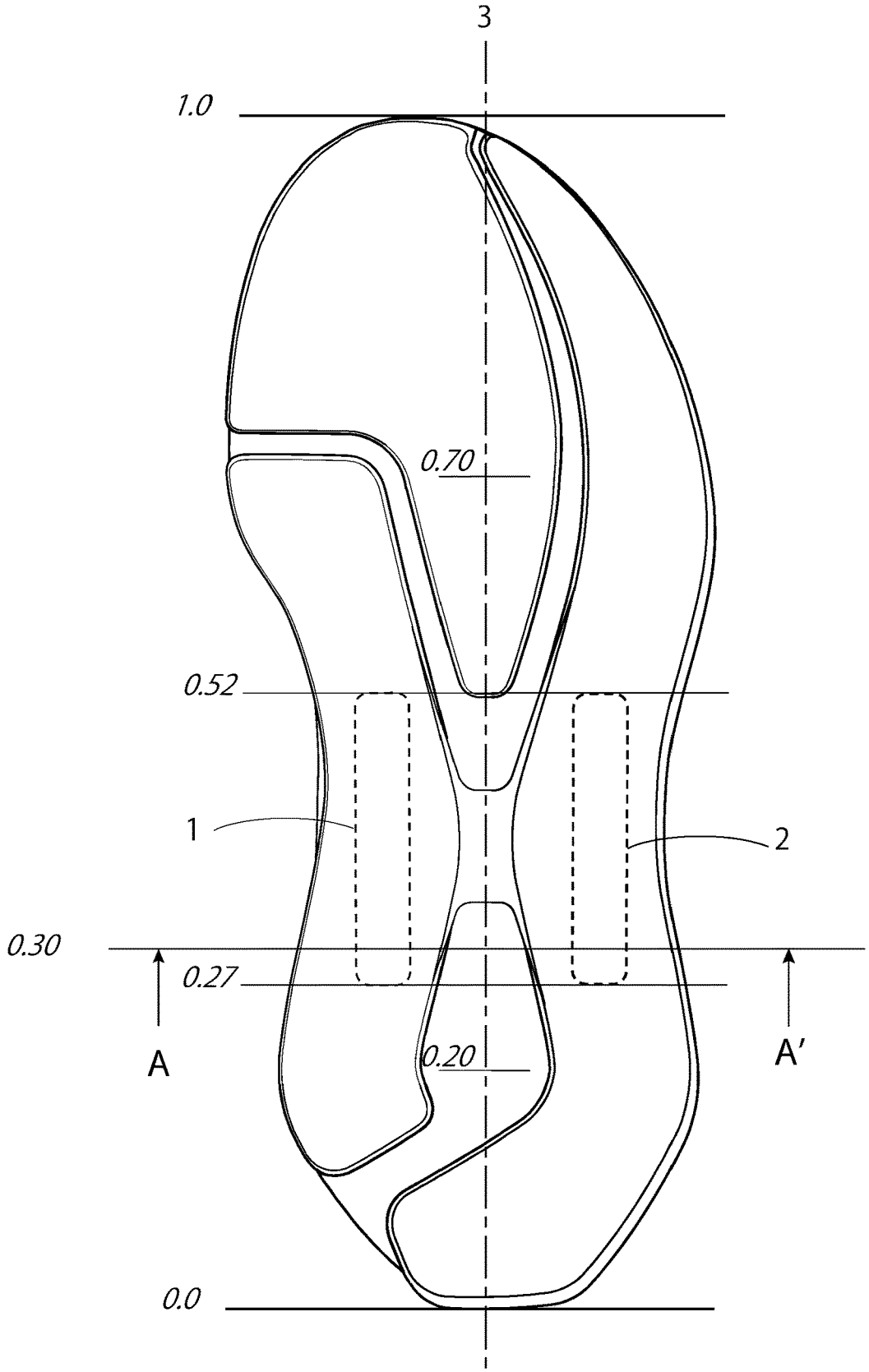
FIG. 2 is a transparent bottom view illustrating an example of a shoe sole, showing a rectangular plate with rounded corners.

FIGS. 2 and 20 illustrate Example 1.

As illustrated in FIG. 2, a first plate 1 and a second plate 2 are disposed in a midfoot portion and are disposed in parallel to a PCL. When the tip of a shoe sole on the toe side is 1 and the tip of the shoe sole on the heel side is 0, the front end of the first plate is disposed at 0.52, the front end of the second plate is disposed at 0.52, the rear end of the first plate is disposed at 0.27, and the rear end of the second plate is disposed at 0.27. The distance between the center of gravity of the first plate and the PCL is 2.7 cm, and the distance between the center of gravity of the second plate and the PCL is 3.0 cm. The plate is made of carbon fiber reinforced plastic. Both of the first plate and the second plate have a length of 7.62 cm, a width of 1.27 cm, a thickness of 1.27 mm and a rectangular shape with rounded corners.

As shown in FIG. 18, the shoe sole of this example has a rocker shape in which both of a top (toe portion) and a tail (rear) are lifted without the uplift in the midfoot portion. The first plate and the second plate are both disposed between a midsole and an outsole, and as a placement position in the height direction, both are disposed at a position of 0.12×H.

Example 2

Figure 3:
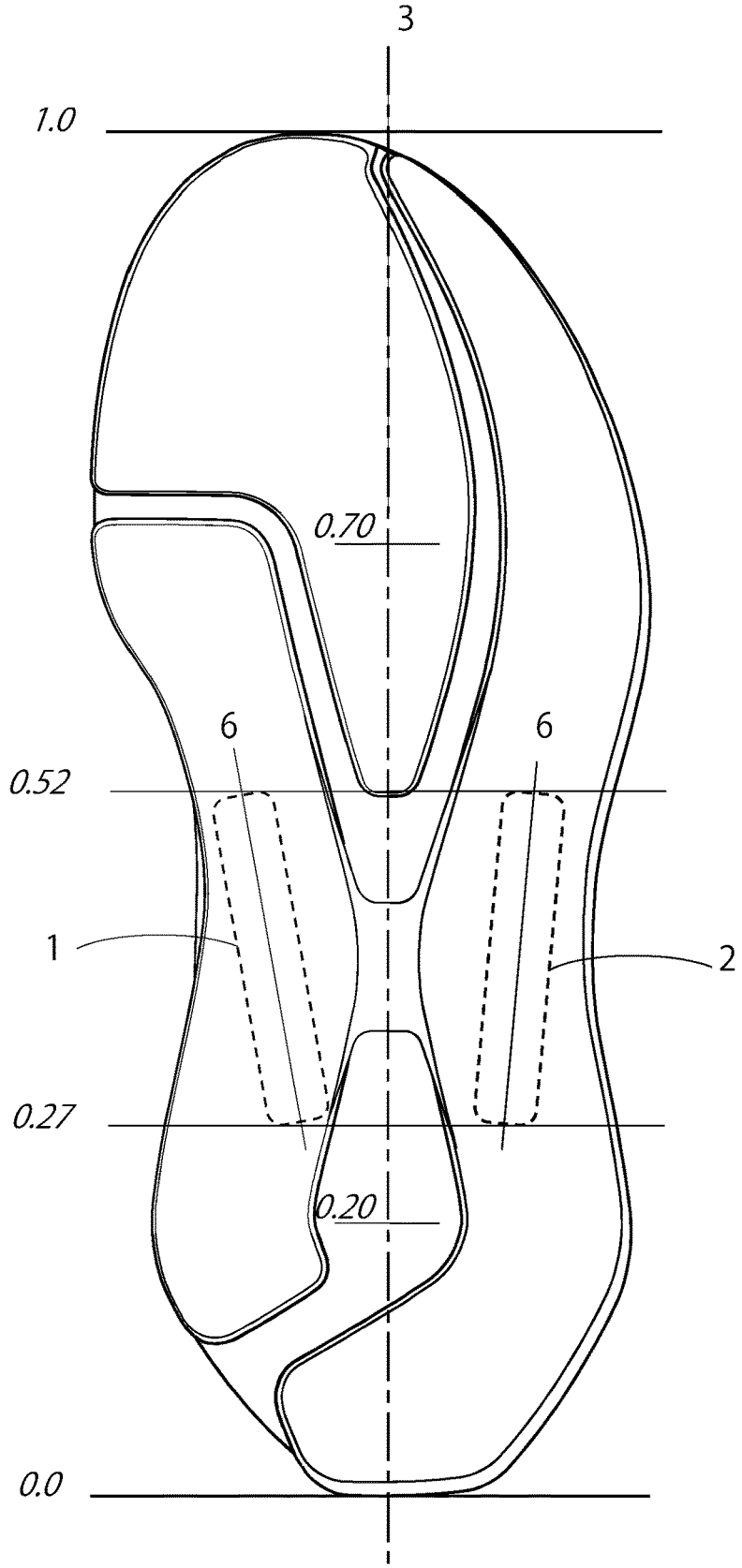
FIG. 3 is a transparent bottom view illustrating another example of a shoe sole.

FIG. 3 illustrates Example 2.

In FIG. 3, a first plate 1 and a second plate 2 are disposed in a midfoot portion. An angle θ formed by the long axis of the first plate and a PCL is 10°, and an angle θ formed by the long axis of the second plate and the PCL is 5°. When the tip of a shoe sole on the toe side is 1 and the tip of the shoe sole on the heel side is 0, the front end of the first plate is disposed at 0.52, the front end of the second plate is disposed at 0.52, the rear end of the first plate is disposed at 0.27, and the rear end of the second plate is disposed at 0.27. The distance between the center of gravity of the first plate and the PCL is 2.6 cm, and the distance between the center of gravity of the second plate and the PCL is 3.0 cm. The plate is made of carbon fiber reinforced plastic. Both of the first plate and the second plate have a length of 7.62 cm, a width of 1.27 cm, a thickness of 1.27 mm, and a rectangular shape with rounded corners. Similarly to Example 1, the shoe sole has a rocker shape in which both of a top (toe portion) and a tail (rear) are lifted without the uplift in the midfoot portion. The first plate and the second plate are both disposed between a midsole and an outsole, and as a placement position in the height direction, both are disposed at a position of 0.12×H.

Example 3

Figure 4:
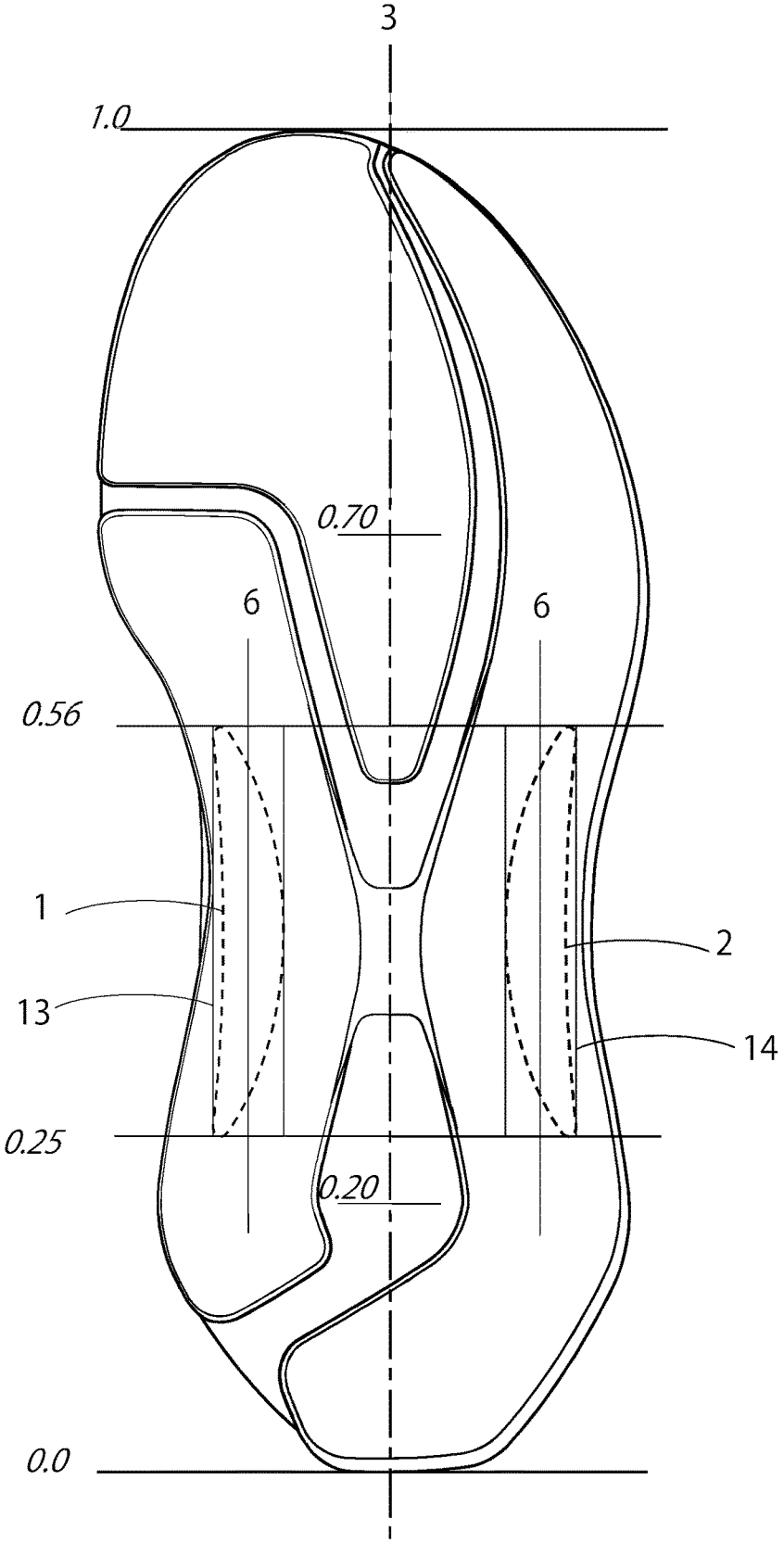
FIG. 4 is a transparent bottom view illustrating another example of a shoe sole.

FIG. 4 illustrates Example 3. In FIG. 4, a first plate 1 and a second plate 2 are disposed in a midfoot portion, and the plates each have an arc shape. Since the shape is an arc, to obtain the angle, a circumscribed rectangle 12 of the first plate and a circumscribed rectangle 13 of the second plate are drawn as illustrated in FIG. 4, and a line connecting the midpoints of the short sides is defined as a plate center line, namely, a long axis of the plate, then the angle is obtained.

An angle θ formed by the long axis of the first plate and a PCL is 0°, and an angle θ formed by the long axis of the second plate and the PCL is 0°. When the total length of a shoe sole is 1 and the rear end of the heel is 0, the front end of the first plate is disposed at 0.56, the front end of the second plate is disposed at 0.56, the rear end of the first plate is disposed at 0.25, and the rear end of the second plate is disposed at 0.25. The distance between the center of gravity of the first plate and the PCL is 3.5 cm, and the distance between the center of gravity of the second plate and the PCL is 3.5 cm. The plate is made of carbon fiber reinforced plastic. A circumscribed rectangle 12 of the first plate and a circumscribed rectangle 13 of the second plate both have a length of 9.30 cm and a width of 1.62 cm, and the first plate and the second plate both have a thickness of 1.27 mm. Similarly to Example 1, the shoe sole has a rocker shape in which both of a top (toe portion) and a tail (rear) are lifted without the uplift in the midfoot portion. The first plate and the second plate are both disposed between a midsole and an outsole, and as a placement position in the height direction, both are disposed at a position of 0.12×H, same as that in Example 1.

Example 4

Figure 5:
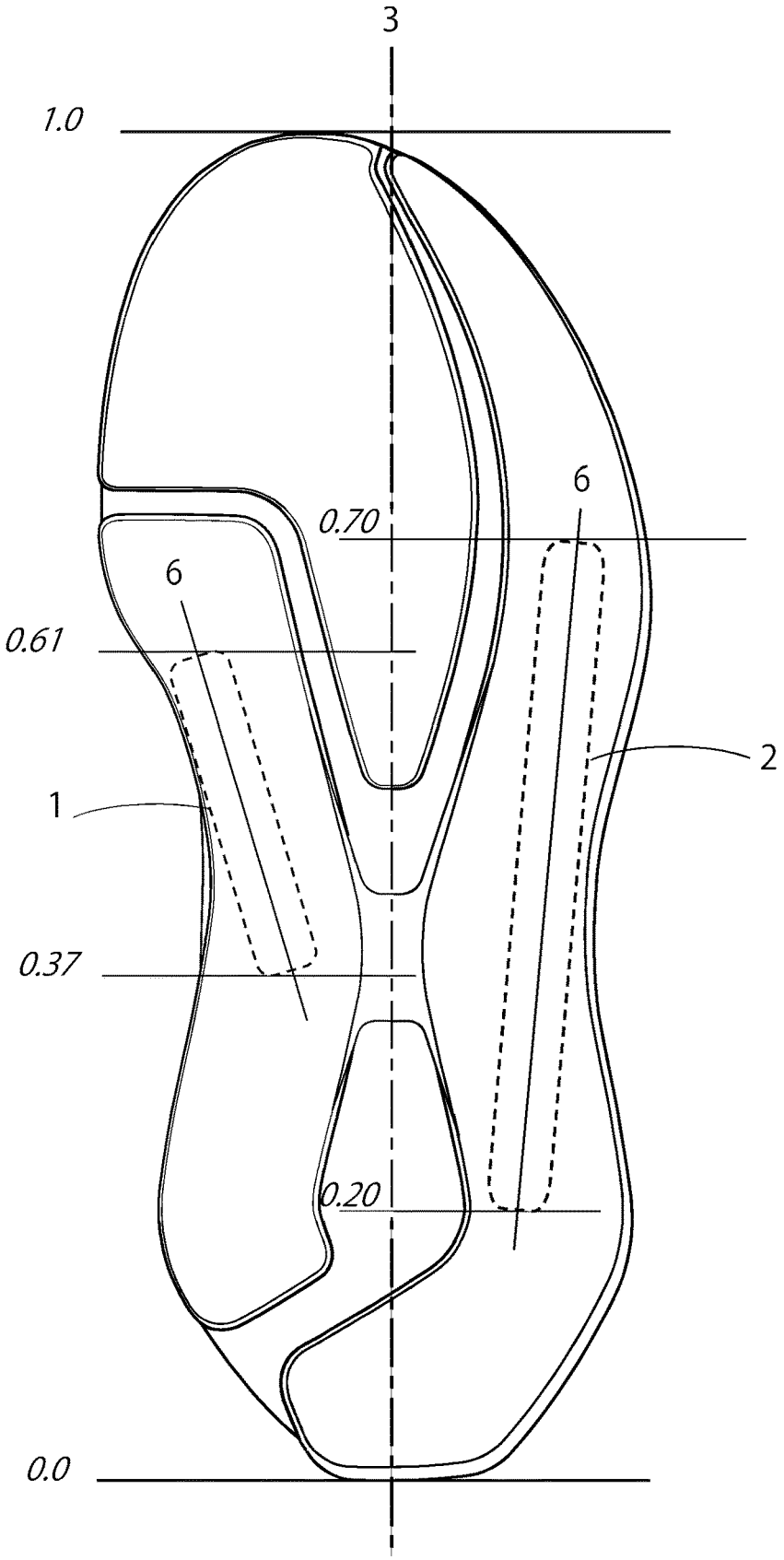
FIG. 5 is a transparent bottom view illustrating another example of a shoe sole.

FIG. 5 illustrates Example 4.

In FIG. 5, a first plate and a second plate are disposed in a midfoot portion. An angle θ formed by the long axis of the first plate and a PCL is 17°, and the angle θ formed by the long axis of the second plate and the PCL is 8.5°. When the total length of a shoe sole is 1 and the heel rear end is 0, the front end of the first plate is disposed at 0.61, the front end of the second plate is disposed at 0.70, the rear end of the first plate is disposed at 0.37, and the rear end of the second plate is disposed at 0.20. The distance between the center of gravity of the first plate and the PCL is 3.5 cm, and the distance between the center of gravity of the second plate and the PCL is 3.6 cm. The plate is made of carbon fiber reinforced plastic. The first plate has a length of 7.62 cm and a width of 1.27 cm, the second plate has a length of 15.5 cm and a width of 1.27 cm, and both have a thickness of 1.27 mm and a rectangular shape with rounded corners. Similarly to Example 1, the shoe sole has a rocker shape in which both of a top (toe portion) and a tail (rear) are lifted without the uplift in the midfoot portion. The first plate and the second plate are both disposed between a midsole and an outsole, and as a placement position in the height direction, both are disposed at 0.12×H, same as that in Example 1.

Example 5

Figure 6:
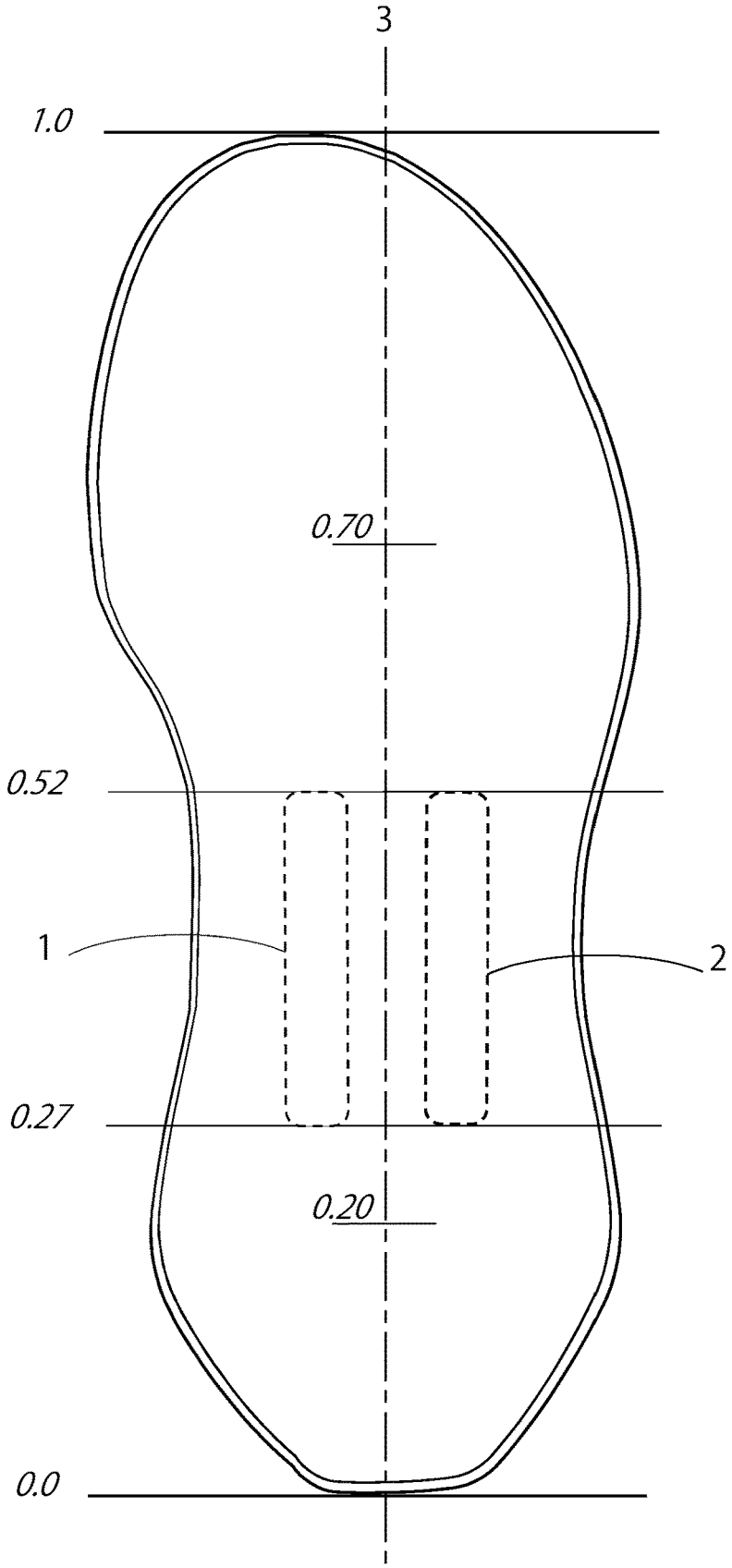
FIG. 6 is a transparent bottom view illustrating another example of a shoe sole.

FIG. 6 illustrates Example 5.

As illustrated in FIG. 6, a first plate 1 and a second plate 2 are disposed in a midfoot portion and are disposed in parallel to a PCL. When the tip of a shoe sole on the toe side is 1 and the tip of the shoe sole on the heel side is 0, the front end of the first plate is disposed at 0.52, the front end of the second plate is disposed at 0.52, the rear end of the first plate is disposed at 0.27, and the rear end of the second plate is disposed at 0.27. The distance between the center of gravity of the first plate and the PCL is 1.6 cm, and the distance between the center of gravity of the second plate and the PCL is 1.6 cm. The plate is made of carbon fiber reinforced plastic. Both of the first plate and the second plate have a length of 7.62 cm, a width of 1.27 cm, a thickness of 1.27 mm and a rectangular shape with rounded corners. Similarly to Example 1, the shoe sole has a rocker shape in which both of a top (toe portion) and a tail (rear) are lifted without the uplift in the midfoot portion. The first plate and the second plate are both disposed between a midsole and an outsole, and as a placement position in the height direction, both are disposed at a position of 0.12×H.

Example 6

Figure 7:
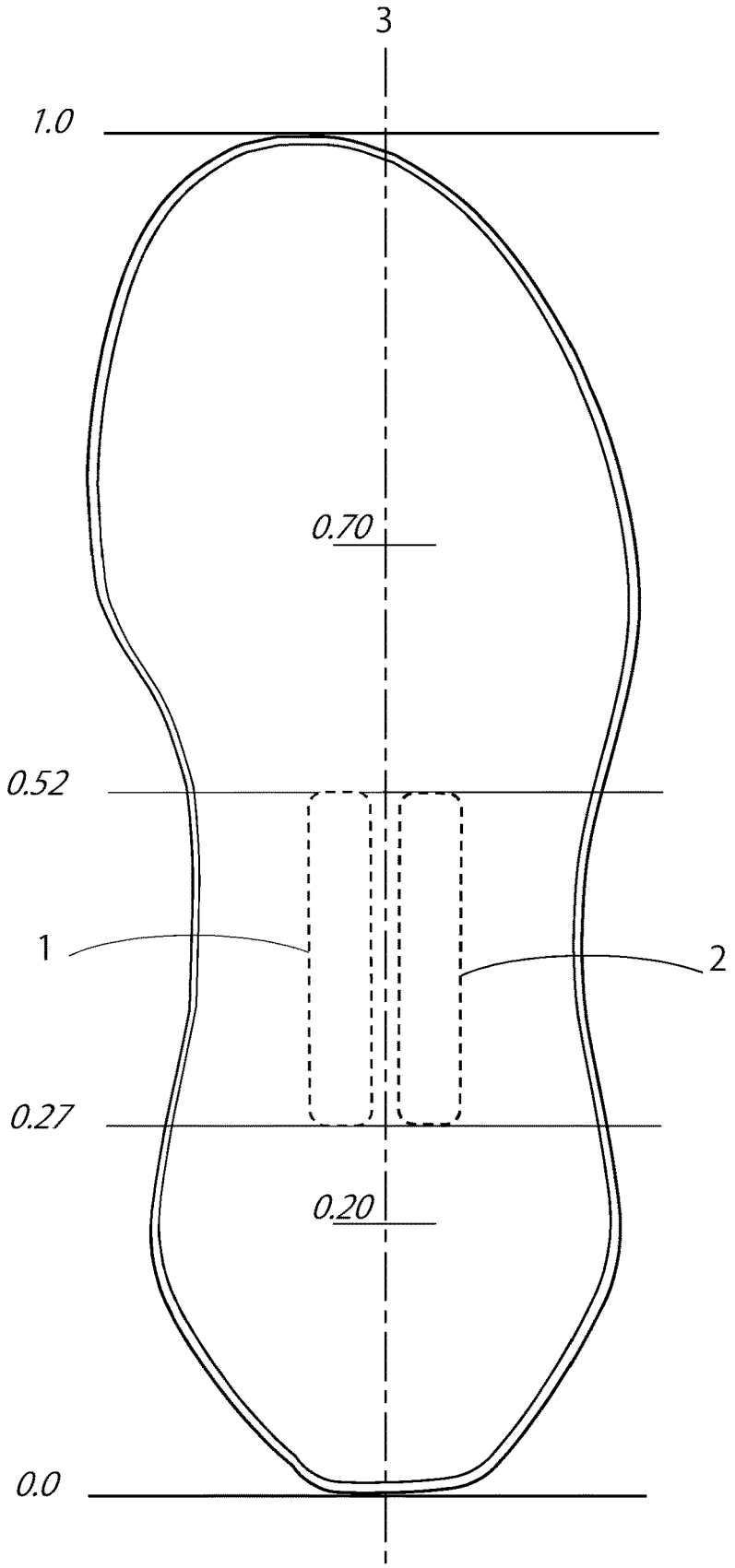
FIG. 7 is a transparent bottom view illustrating another example of a shoe sole.

FIG. 7 illustrates Example 6.

As illustrated in FIG. 7, a first plate 1 and a second plate 2 are disposed in a midfoot portion and are disposed in parallel to a PCL. When the tip of a shoe sole on the toe side is 1 and the tip of the shoe sole on the heel side is 0, the front end of the first plate is disposed at 0.52, the front end of the second plate is disposed at 0.52, the rear end of the first plate is disposed at 0.27, and the rear end of the second plate is disposed at 0.27. The distance between the center of gravity of the first plate and the PCL is 0.99 cm, and the distance between the center of gravity of the second plate and the PCL is 0.99 cm. The plate is made of carbon fiber reinforced plastic. Both of the first plate and the second plate have a length of 7.62 cm, a width of 1.27 cm, a thickness of 1.27 mm and a rectangular shape with rounded corners. Similarly to Example 1, the shoe sole has a rocker shape in which both of a top (toe portion) and a tail (rear) are lifted without the uplift in the midfoot portion. The first plate and the second plate are both disposed between a midsole and an outsole, and as a placement position in the height direction, both are disposed at a position of 0.12×H.

Comparative Example 1

A shoe sole not having a plate and including a midsole that is made of EVA and has a rocker shape.

Comparative Example 2

Figure 8:
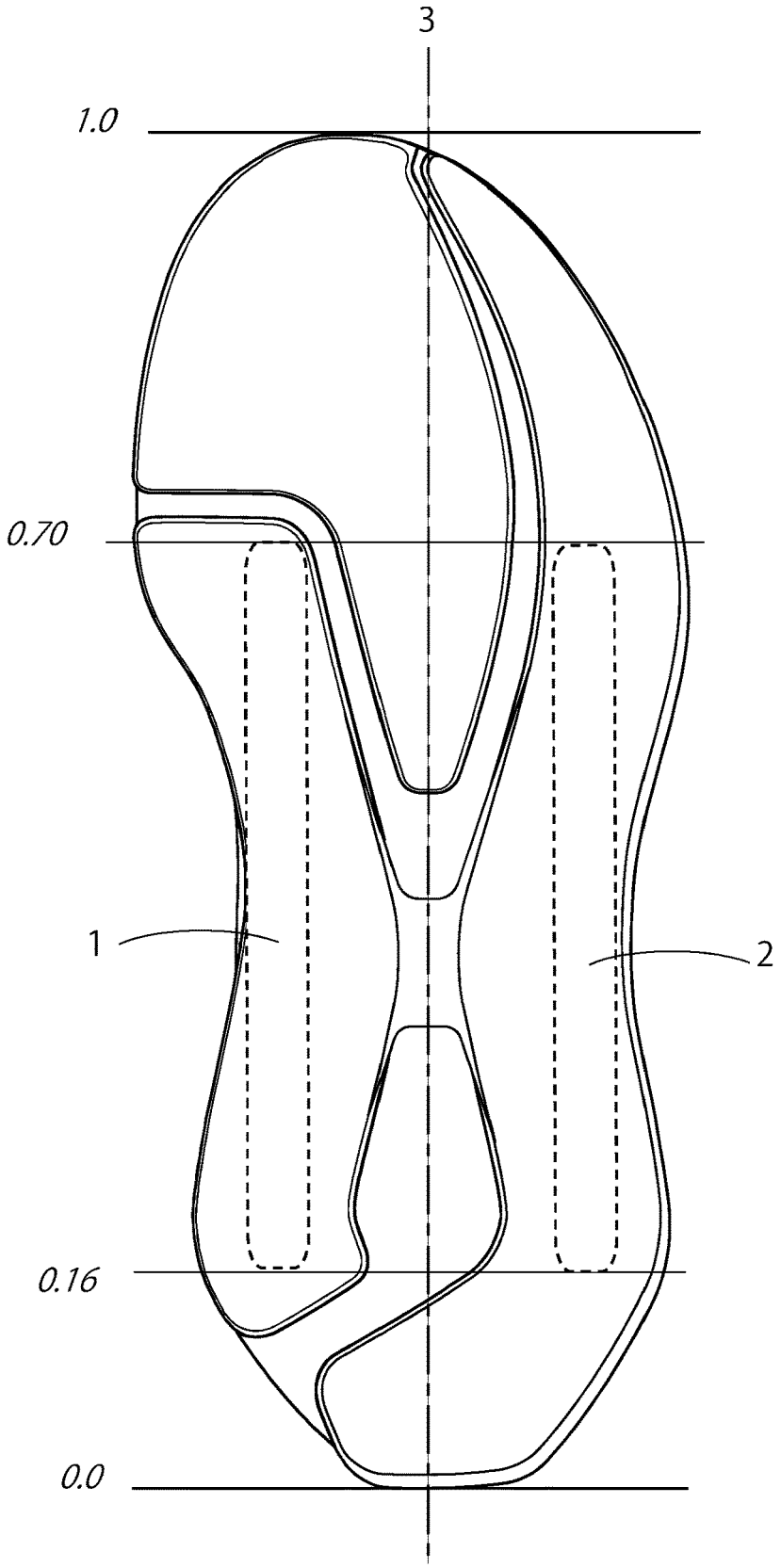
FIG. 8 is a transparent bottom view illustrating a comparative example of a shoe sole.

In FIG. 8, a first plate and a second plate are disposed in a midfoot portion and are disposed parallel to a PCL. When the total length of a shoe sole is 1 and the rear end of the heel is 0, the front end of the first plate is disposed at 0.70, the front end of the second plate is disposed at 0.70, the rear end of the first plate is disposed at 0.16, and the rear end of the second plate is disposed at 0.16. The distance between the center of gravity of the first plate and the PCL is 3.5 cm, and the distance between the center of gravity of the second plate and the PCL is 3.5 cm. The plate is made of carbon fiber reinforced plastic. Both of the first plate and the second plate have a length of 16.5 cm, a width of 1.27 cm, a thickness of 1.27 mm and a rectangular shape with rounded corners.

The shoe sole has a rocker shape in which both of a top (toe portion) and a tail (rear) are lifted without the uplift in the midfoot portion. The first plate and the second plate are both disposed between a midsole and an outsole, and as a placement position in the height direction, both are disposed at a position of 0.12×H.

The details of the items measured in each experiment are as follows:

Exercise Condition 1 (running): Eight male subjects ran on the force plate at a pace of eight minutes/mile while wearing the shoes using the shoe soles of respective Examples and Comparative Examples, and the floor reaction force (N/kg) was measured for each of impact at the time of heel landing (Deceleration Impact), propulsion of kicking (Acceleration/Propulsion), and stability of left and right shakes from landing to foot release (Stability), and an average of floor reaction forces of eight subjects was adopted. The smaller floor reaction force of the impact at the time of heel landing is excellent, which means that the smaller floor reaction force has an excellent impact absorbing property. In addition, the smaller floor reaction force corresponding to the stability of left and right shakes up to foot release is excellent. On the other hand, it is determined that the larger propulsion of kicking is excellent as characteristics of the shoe.

Exercise Condition 2 (walking): Eight male subjects walked while wearing the shoes using the shoe soles of respective Examples and Comparative Examples, and the floor reaction force (N/kg) was measured for each of impact at the time of heel landing (Deceleration Impact), propulsion of kicking (Acceleration/Propulsion), and stability of left and right shakes from landing to foot release (Stability).

Tasters score: A questionnaire was conducted for the above eight male subjects, and the following items were scored to calculate the average score of eight subjects for each of Examples and Comparative Examples. The items are overall comfort, heel cushion, and forefoot cushion. The score was set to seven levels of 4: acceptable, 3: poor, 2: very poor, 1: extremely poor, 5: good, 6: very good, and 7: extremely good.

Table 1 summarizes the relationship between the plate placement of Examples and Comparative Examples.

Table 2 indicates the test results under Exercise Conditions 1 and 2.

Table 3 indicates the tasters scores by eight subjects.

TABLE 1

| Subject | shape | length × width (cm) | θ (degree) | Comparative Front Position | Comparative Back Position | Comparative Plate Height |
|---|---|---|---|---|---|---|
| | First plate geometry | | | | | |
| Example 1 | rectangular | 7.62 × 1.27 | 0 | 0.52 | 0.27 | 0.12 |
| Example 2 | rectangular | 7.62 × 1.27 | 10 | 0.52 | 0.27 | 0.12 |
| Example 3 | Arc | 9.30 × 1.62 | 0 | 0.56 | 0.25 | 0.12 |
| Example 4 | rectangular | 7.62 × 1.27 | 17 | 0.61 | 0.37 | 0.12 |
| Example 5 | rectangular | 7.62 × 1.27 | 0 | 0.52 | 0.27 | 0.12 |
| Example 6 | rectangular | 7.62 × 1.27 | 0 | 0.52 | 0.27 | 0.12 |
| Comparative Example 1 | no | no | no | no | no | no |
| Comparative Example 2 | rectangular | 16.5 × 1.27 | 0 | 0.7 | 0.16 | 0.12 |
| | Second plate geometry | | | | | |
| Example 1 | rectangular | 7.62 × 1.27 | 0 | 0.52 | 0.27 | 0.12 |
| Example 2 | rectangular | 7.62 × 1.27 | 5 | 0.52 | 0.27 | 0.12 |
| Example 3 | Arc | 9.30 × 1.62 | 0 | 0.56 | 0.25 | 0.12 |
| Example 4 | rectangular | 15.5 × 1.27 | 8.5 | 0.7 | 0.2 | 0.12 |
| Example 5 | rectangular | 7.62 × 1.27 | 0 | 0.52 | 0.27 | 0.12 |
| Example 6 | rectangular | 7.62 × 1.27 | 0 | 0.52 | 0.27 | 0.12 |
| Comparative Example 1 | no | no | no | no | no | no |
| Comparative Example 2 | rectangular | 16.5 × 1.27 | 0 | 0.7 | 0.16 | 0.12 |

TABLE 2

| Subject | Deceleration Impact (N/kg) | Acceleration/ Propulsion (N/kg) | Stability (N/kg) |
|---|---|---|---|
| | Running | | |
| Example 1 | 3.97 | 2.99 | 14.89 |
| Example 2 | 3.91 | 3.01 | 14.91 |
| Example 3 | 3.94 | 3.03 | 14.92 |
| Example 4 | 4.02 | 3.12 | 17.24 |
| Example 5 | 3.95 | 3.02 | 14.9 |
| Example 6 | 4.01 | 3.03 | 17.22 |
| Comparative Example 1 | 4.1 | 3.01 | 19.54 |
| Comparative Example 2 | 4.12 | 3.2 | 19.09 |
| | Walking | | |
| Example 1 | 3.26 | 2.39 | 19.05 |
| Example 2 | 3.29 | 2.38 | 19.15 |
| Example 3 | 3.26 | 2.37 | 19.07 |
| Example 4 | 3.43 | 2.36 | 19.98 |
| Example 5 | 3.27 | 2.4 | 19.11 |
| Example 6 | 3.26 | 2.41 | 20.1 |
| Comparative Example 1 | 3.17 | 2.42 | 20.42 |
| Comparative Example 2 | 3.54 | 2.47 | 20.2 |

TABLE 3

| | Tasters score Overall comfort | Heel Cushion | Forefoot Cushion |
|---|---|---|---|
| Example 1 | 5.4 | 6.8 | 6 |
| Example 2 | 5.5 | 6.4 | 6.1 |
| Example 3 | 5.4 | 6.8 | 6.1 |
| Example 4 | 5 | 6 | 6 |
| Example 5 | 5.4 | 6.8 | 6 |
| Example 6 | 5 | 6.4 | 6 |
| Comparative Example 1 | 4.8 | 4.3 | 3.9 |
| Comparative Example 2 | 4.1 | 3.9 | 4 |

It can be seen from Table 2 that our Examples have a smaller impact at the time of heel landing than Comparative Examples, and is excellent in stability from landing to foot release (particularly at the time of walking) without impairing the propulsion of kicking. In addition, as indicated in Table 3, the tasters scores were also superior to those of Comparative Examples. It can be seen that stability and rapid weight movement in a desired direction are excellent under each Exercise Conditions.

Our shoe soles are lightweight, have good wearing comfort, and can be used on the street. In addition, our shoe soles can be used not only for running and jogging but also for a wide range of sports such as golf, tennis, basketball, soccer, and skateboarding.

The invention claimed is:

1. A shoe sole comprising:

a shoe sole main body made of a flexible material; and at least two plates made of a material having a flexural modulus higher than a flexural modulus of the flexible material constituting the shoe sole main body, wherein each of the at least two plates is spaced inwardly from and away from respective medial and lateral sidewalls of the shoe sole, and wherein two plates of the at least two of the plates satisfy all of Conditions (1) to (3):

(1) in a transparent bottom view of the shoe sole, one of the two plates of the at least two of the plates is disposed on an inner instep side and the other plate is disposed on an outer instep side with respect to a longitudinal center line (LCL) and those two plates are not connected;

(2) long axes of the two plates of the at least two of the plates both form an angle of 0° to 30° with respect to the LCL; and (3) the shoe sole main body has a toe end tip and a heel end tip, wherein a length of the shoe sole main body is measured from the heel end tip to the toe end tip, wherein both of the two plates of the at least two plates are entirely disposed in a region of the length beginning at 20% of the length and terminating at 70% of the length, as measured in a direction from the heel end tip towards the toe end tip;

wherein the material of the at least two plates is carbon fiber reinforced plastic.

2. The shoe sole according to claim 1, wherein a shape of the shoe sole is a rocker shape.

3. The shoe sole according to claim 1, wherein the shoe sole has a height defined by and between a top-most point of the shoe sole and a bottom-most point of the shoe sole, wherein both of the two plates of the at least two plates are disposed in a vertical region of the height beginning at 5% of the height and terminating at 50% of the height, as measured in a direction from the bottom-most point toward the top-most point.

4. The shoe sole according to claim 1, wherein at least one plate of the at least two of the plates has a shape bulging with respect to a ground surface.

5. The shoe sole according to claim 1, wherein at least one plate of the at least two of the plates has a corrugated shape.

6. The shoe sole according to claim 1, wherein a distance between the center of gravity of the two plates of the at least two plates and the LCL is 1.0 cm to 4.0 cm.

7. The shoe sole according to claim 1, wherein a distance between the center of gravity of the two plates of the at least two plates and the LCL is 1.0 cm to 3.5 cm.

8. The sole according to claim 1, wherein a shape of the two plates of the at least two plates is a rectangle or a rectangle having rounded corners, and the two plates of the at least two plates have a length of 2 cm to 10 cm.

* * * * *